US009409064B2

(12) United States Patent
Fitchett et al.

(10) Patent No.: US 9,409,064 B2
(45) **Date of Patent: *Aug. 9, 2016**

(54) GOLF BALL HAVING AN AERODYNAMIC COATING INCLUDING MICRO SURFACE ROUGHNESS

(75) Inventors: Derek A. Fitchett, Beaverton, OR (US); Johannes Anderl, Vienna (AT)

(73) Assignee: NIKE, Inc., Beaverton, OR (US)

( * ) Notice: Subject to any disclaimer, the term of this patent is extended or adjusted under 35 U.S.C. 154(b) by 321 days.

This patent is subject to a terminal disclaimer.

(21) Appl. No.: 13/184,254

(22) Filed: Jul. 15, 2011

(65) Prior Publication Data

US 2012/0184397 A1 Jul. 19, 2012

Related U.S. Application Data

(63) Continuation-in-part of application No. 12/569,955, filed on Sep. 30, 2009.

(51) Int. Cl.

| | |
|---|---|
| ***A63B 37/06*** | (2006.01) |
| ***A63B 37/12*** | (2006.01) |
| ***A63B 37/00*** | (2006.01) |
| ***A63B 45/00*** | (2006.01) |

(52) U.S. Cl.

CPC ..... *A63B 37/12* (2013.01); *A63B 37/0022* (2013.01); *A63B 45/00* (2013.01)

USPC ..... 473/378

(58) Field of Classification Search

CPC ..... A63B 37/0005; A63B 37/0022

USPC ..... 473/378

See application file for complete search history.

(56) References Cited

U.S. PATENT DOCUMENTS

| | | | |
|---|---|---|---|
| 3,819,190 | A | 6/1974 | Nepela et al. |
| 4,266,733 | A | 5/1981 | Butler |
| 4,266,773 | A | 5/1981 | Treadwell |
| 4,284,276 | A | 8/1981 | Worst |
| 4,438,924 | A | 3/1984 | Carr |

(Continued)

FOREIGN PATENT DOCUMENTS

| | | | |
|---|---|---|---|
| CN | 1953790 | A | 4/2007 |
| EP | 2314359 | A1 | 4/2011 |

(Continued)

OTHER PUBLICATIONS

Elmar Achenbach (1974), "The Effects of Surface Roughness and Tunnel Blockage on the Flow Past Spheres," J. Fluid Mechanics, vol. 65, part 1, pp. 113-125.

Sajima, T., Yamaguchi, T., Yabu, M., and Tsunoda, M. (2006), The Aerodynamic Influence of Dimple Design on Flying Golf Ball, in Springer (ed.), Engineering of Sport 6, p. 143.

Jin Choi, Woo-Pyung Jeon, and Haecheon Choi (2006), "Mechanism of Drag Reduction by Dimples on a Sphere," by Physics of Fluids 18, pp. 1-4.

(Continued)

*Primary Examiner* — Raeann Gorden

(74) *Attorney, Agent, or Firm* — Banner & Witcoff, Ltd.

(57) ABSTRACT

Golf balls include: (a) a golf ball body having a first set of construction specifications and a first dimple pattern formed on an outer surface of the golf ball body; and (b) a coating applied to the outer surface of the golf ball body to thereby produce a coated golf ball body having an exterior surface. At least one of the outer surface of the golf ball body and the coating includes a plurality of surface roughening particles to provide increased micro surface roughness as compared to golf balls having the same set of construction specifications and the same dimple pattern but without the micro surface roughening particles. The micro surface roughening affects the aerodynamic properties of the ball.

25 Claims, 11 Drawing Sheets

(56) References Cited

U.S. PATENT DOCUMENTS

| | | | | |
|---|---|---|---|---|
| 4,987,702 | A | 1/1991 | Anschutz | |
| 5,427,378 | A | 6/1995 | Murphy | |
| 5,766,097 | A | 6/1998 | Horiuchi et al. | |
| 5,830,077 | A | 11/1998 | Yavitz | |
| 5,984,806 | A | 11/1999 | Sullivan et al. | |
| 6,193,617 | B1 * | 2/2001 | Mertens | 473/351 |
| 6,315,681 | B1 | 11/2001 | Sullivan | |
| 6,475,106 | B1 | 11/2002 | Green et al. | |
| 6,569,038 | B2 | 5/2003 | Sullivan | |
| 6,596,837 | B2 | 7/2003 | Hogge et al. | |
| 6,729,976 | B2 | 5/2004 | Bissonnette et al. | |
| 6,743,123 | B2 | 6/2004 | Sullivan | |
| 6,821,191 | B2 | 11/2004 | Lim et al. | |
| 6,849,007 | B2 | 2/2005 | Morgan et al. | |
| 6,866,802 | B2 | 3/2005 | Puniello et al. | |
| 6,902,498 | B2 | 6/2005 | Sullivan et al. | |
| 6,908,402 | B2 | 6/2005 | Sullivan et al. | |
| 6,919,395 | B2 | 7/2005 | Rajagopalan et al. | |
| 6,939,249 | B2 | 9/2005 | Sullivan | |
| 6,945,878 | B2 | 9/2005 | Binette et al. | |
| 6,991,563 | B2 | 1/2006 | Sullivan et al. | |
| 7,115,050 | B2 | 10/2006 | Andre et al. | |
| 7,232,384 | B2 | 6/2007 | Sullivan et al. | |
| 7,281,997 | B2 | 10/2007 | Kennedy, III et al. | |
| 7,388,053 | B2 | 6/2008 | Sullivan et al. | |
| 7,534,834 | B2 | 5/2009 | Onoda et al. | |
| 8,275,587 | B2 | 9/2012 | Sato et al. | |
| 9,033,825 | B2 * | 5/2015 | Anderl | A63B 37/0022 473/378 |
| 9,033,826 | B2 * | 5/2015 | Fitchett | A63B 37/0022 473/378 |
| 2002/0025864 | A1 | 2/2002 | Barfield | |
| 2002/0077195 | A1 | 6/2002 | Carr et al. | |
| 2002/0173384 | A1 | 11/2002 | Hogge et al. | |
| 2003/0114252 | A1 | 6/2003 | Hayashi et al. | |
| 2003/0119608 | A1 | 6/2003 | Hayashi et al. | |
| 2003/0148828 | A1 | 8/2003 | Isogawa | |
| 2004/0015602 | A1 | 1/2004 | Goldhammer et al. | |
| 2004/0052970 | A1 | 3/2004 | Ohira | |
| 2004/0053707 | A1 | 3/2004 | Ohira | |
| 2004/0087389 | A1 | 5/2004 | Kasashima et al. | |
| 2004/0266559 | A1 | 12/2004 | Asakura | |
| 2005/0277488 | A1 | 12/2005 | Onoda et al. | |
| 2006/0030428 | A1 | 2/2006 | Ohira | |
| 2006/0148591 | A1 | 7/2006 | Hebert et al. | |
| 2007/0015602 | A1 | 1/2007 | Watanabe | |
| 2007/0093318 | A1 | 4/2007 | Bartsch et al. | |
| 2007/0213143 | A1 | 9/2007 | Chinn et al. | |
| 2008/0064529 | A1 | 3/2008 | Kennedy, III et al. | |
| 2008/0220907 | A1 | 9/2008 | Aoyama et al. | |
| 2008/0280699 | A1 | 11/2008 | Jarvholm | |
| 2009/0111614 | A1 | 4/2009 | Ohira | |
| 2010/0037914 | A1 | 2/2010 | Miller | |
| 2010/0311521 | A1 | 12/2010 | Ohira | |
| 2011/0077106 | A1 | 3/2011 | Fitchett | |
| 2011/0136590 | A1 | 6/2011 | Kim et al. | |
| 2011/0177885 | A1 | 7/2011 | Ichikawa | |
| 2011/0183777 | A1 | 7/2011 | Oh | |
| 2011/0190077 | A1 | 8/2011 | Sajima et al. | |
| 2013/0104932 | A1 | 5/2013 | Fehsenfeld et al. | |
| 2013/0168896 | A1 | 7/2013 | Tutmark | |

FOREIGN PATENT DOCUMENTS

| | | | |
|---|---|---|---|
| JP | H07194733 | | 8/1995 |
| JP | 2002-536136 | A | 10/2002 |
| JP | 2002-369896 | | 12/2002 |
| JP | 2002369896 | A | 12/2002 |
| JP | 2002543945 | | 12/2002 |
| JP | 200481350 | A | 3/2004 |
| JP | 2004-107485 | A | 4/2004 |
| JP | 2004-130111 | A | 4/2004 |
| JP | 2004-147836 | | 5/2004 |
| JP | 2004-147836 | A | 5/2004 |
| JP | 2005027774 | A | 2/2005 |
| JP | 2006-051357 | A | 2/2006 |
| JP | 2006075210 | A | 3/2006 |
| JP | 08-308958 | A | 11/2006 |
| JP | 2007260317 | A | 10/2007 |
| JP | 2008-161375 | A | 7/2008 |
| JP | 2009106720 | A | 5/2009 |
| WO | 9843711 | A1 | 10/1998 |
| WO | 0069526 | | 11/2000 |
| WO | 01/52944 | A1 | 7/2001 |
| WO | 2008/137973 | A1 | 11/2008 |

OTHER PUBLICATIONS

Kimura, T. and Tsutahara, M. (1990), "Fluid Dynamic Effects of Grooves on Circular Cylinder Surface," AIAA Journal, vol. 29, No. 12, pp. 2062-2068.

Mehta, R.D. and Pallis, J.M. (2001), "Sports Ball Aerodynamics: Effects of Velocity, Spin, and Surface Roughness," Materials and Science in Sports, TMS, p. 185.

Smits, A.J., and Smith, D.R. (1994), "A New Aerodynamic Model of a Golf Ball in Flight," Science and Golf II: Proceedings of the World Scientific Congress of Golf, London: E & FN Spon.

Ting, L.L. (2003), "Effects of Dimple Size and Depth on Golf Ball Aerodynamic Performance," Proceedings of FEDSM'03 4th ASME_JSME Joint Fluids Engineering Conference, pp. 811-817.

Smith, C., Beratlis, N., Balaras, E., Squires, K., and Tsunoda, M. (2008), "Direct Numerical Simulation of the Flow Around a Golf Ball," Science and Golf V, Proceedings of the World Scientific Congress of Golf, Mesa: Energy in Motion Inc., p. 421.

Quintavalla, S. ((2002), "Golf Ball Performance Evaluation Using High-Volume Indoor Aerodynamic Testing," ITEA Journal, January, pp. 21-25.

Limited R&A Rules (2005), Rule 5—The Golf Ball, in A Guide to the Rules of Clubs and Balls, 2nd Edition, pp. 41-42.

European Search Report issued in EPO Patent Application No. 10172697.4 on Mar. 11, 2011.

PCT/US2012/046648 International Search Report dated Oct. 5, 2012.

Chinese Patent Application No. 201010295506.1 Second Office Action dated Aug. 31, 2012.

PCT/US2012/046904 International Search Report dated Jan. 28, 2013.

Questioning for corresponding Japanese Patent Application 2010-180877 dated Sep. 26, 2011.

Notification from Japanese Patent Office for corresponding Japanese Patent Application No. 2011-156290 dated Mar. 26, 2012.

Third-Party Submission of Information for corresponding Japanese Patent Application No. 2011-156290 dated Mar. 15, 2012.

Non-Final Office Action for U.S. Appl. No. 12/569,955, mailed Jun. 6, 2012, 27 pages.

Japanese Patent Application No. 2011-156290 Notice of Reasons for Rejection dated Jun. 19, 2013.

PCT/US2012/046750 International Search Report dated Oct. 5, 2012.

Apr. 23, 2015—(JP) Office Action—JP2014-521675.

Apr. 23, 2015—(JP) Office Action—App JP2014-521667.

Apr. 23, 2015—(JP) Office Action—App JP2014-521692.

Mar. 23, 2016—(JP) Office Action—App 2014521692—Eng Tran.

Certified English Translation of JP 2006075210 (published Mar. 23, 2006), translation certified on Feb. 24, 2016.

Certified English Translation of JP 2004147836 (published May 27, 2004), translation certified on Apr. 29, 2015.

Machine English Translation of previously submitted JP2002-369896, translation dated Nov. 24, 2014.

Machine English Translation of previously submitted JP2004-147836, translation dated Nov. 24, 2014.

* cited by examiner

Ra = Average (1, 4, 6, 8, 5, 2, 1, 4, 1, 2, 1, 4, 7, 4, 1, 2, 5, 8, 5, 2, 1, 4, 1, 1)

Ra = 3.33

GOLF BALL HAVING AN AERODYNAMIC COATING INCLUDING MICRO SURFACE ROUGHNESS

RELATED APPLICATION DATA

This application is a continuation-in-part of U.S. patent application Ser. No. 12/569,955 filed Sep. 30, 2009 in the name of Derek Fitchett. This parent application is entirely incorporated herein by reference.

FIELD OF THE INVENTION

The present invention relates to golf balls. Particular example aspects of this invention relate to golf balls having a coating with micro surface roughness that improves the aerodynamic performance of the ball.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golfs popularity in recent years.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rate measurement technology, ball fitting technology, etc.).

Modern golf balls generally comprise either a one-piece construction or several layers including an outer cover surrounding a core. Typically, one or more layers of paint and/or other coatings are applied to the outer surface of the golf ball. For example, in one typical design, the outer surface of the golf ball is first painted with at least one clear or pigmented basecoat primer followed by at least one application of a clear coating or topcoat. The clear coating may serve a variety of functions, such as protecting the cover material (e.g., improving abrasion resistance or durability), improving aerodynamics of ball flight, preventing yellowing, and/or improving aesthetics of the ball.

One common coating utilizes a solvent borne two-component polyurethane, which is applied to the exterior of a golf ball. The coating may be applied, for example, by using compressed air or other gas to deliver and spray the coating materials. The balls and spray nozzles may be rotated with respect to one another to provide an even coating layer over the entire ball surface.

Dimples were added to golf balls to improve the aerodynamics as compared with smooth balls. Variations of the dimples have been introduced over the years relating to their size, shape, depth, and pattern. Other concepts have included the inclusion of small dimples or other structures within dimples to provide different aerodynamic performance. Such small dimples or other structures, however, often fill up during application of a paint or top coat to the outer surface of the ball, thus destroying or reducing the intended dimple-in-dimple aerodynamic effect of the balls.

While the industry has witnessed dramatic changes and improvements to golf equipment in recent years, some players continue to look for increased distance on their golf shots, particularly on their drives or long iron shots, and/or improved spin or control of their shots, particularly around the greens and/or at initial launch. Accordingly, there is room in the art for further advances in golf technology.

SUMMARY

The following presents a general summary of aspects of the disclosure in order to provide a basic understanding of the disclosure and various aspects of this invention. This summary is not intended to limit the scope of the invention in any way, but it simply provides a general overview and context for the more detailed description that follows.

Aspects of this invention are directed to golf balls having increased micro surface roughness. Such golf balls may include, for example: (a) a golf ball body having a first set of construction specifications and a first dimple pattern formed on an outer surface of the golf ball body; and (b) a coating applied to the outer surface of the golf ball body to thereby produce a coated golf ball body having an exterior surface. At least one of the outer surface of the golf ball body and the coating includes a plurality of surface roughening particles to provide increased micro surface roughness as compared to golf balls having the same set of construction specifications and the same dimple pattern but without the micro surface roughening particles.

In at least some aspects of this invention, the surface roughening particles will be present in a sufficient amount at the exterior surface of the coated golf ball body such that a micro surface roughness of the exterior surface of the golf ball is at least 1.75 times larger than a micro surface roughness of an exterior surface of a comparative ball having the first set of construction specifications and the first dimple pattern but not including the surface roughening particles. The micro surface roughness includes deviations from an ideal surface of 0.25 mm or less. The micro surface roughness may constitute an average micro surface roughness of at least 7.5% of an entire surface area of the ball, wherein the 7.5% of the entire surface areas is dispersed over at least 36 discrete locations on the surface of the ball (e.g., the surface area containing or surrounding at least 36 different dimples dispersed around the ball's surface).

In other aspects of this invention, the surface roughening particles will be present in a sufficient amount at the exterior surface of the coated golf ball body such that one or more of the following conditions are met: (a) the golf ball exhibits a coefficient of lift at initial launch that is at least 5% higher as compared to a coefficient of lift at initial launch of a comparative ball having the first set of construction specifications and the first dimple pattern but not including the surface roughening particles; (b) the golf ball exhibits a maximum coefficient of lift at a location at least 15 yards farther from an initial launch point as compared to a location of a maximum coefficient of lift of a comparative ball having the first set of construction specifications and the first dimple pattern but not including the surface roughening particles; (c) the golf ball exhibits a maximum coefficient of lift that is at least 5% higher than a maximum coefficient of lift of a comparative ball having the first set of construction specifications and the first dimple pattern but not including the surface roughening particles; (d) the golf ball exhibits a higher coefficient of lift throughout its descent as compared to a coefficient of lift during descent of a comparative ball having the first set of construction specifications and the first dimple pattern but not including the surface roughening particles; and/or (e) the golf ball exhibits a ratio of coefficient of lift to coefficient of drag at initial launch that is at least 4% higher as compared to a ratio of coefficient of lift to coefficient of drag at initial launch of a comparative ball having the first set of construction specifications and the first dimple pattern but not including the surface roughening particles. These conditions are measured using standard USGA indoor test range testing protocols with balls launched in a pole orientation at an initial launch velocity of 242 ft/s, an initial launch angle of 11.3°, and an initial launch spin of 44.7 revolutions/s.

As used herein, balls will be considered to have the "same ball construction" if they are made to the same construction specifications with the exception of the roughening material incorporated into the structure (e.g., same core size and materials, same intermediate layer(s) size(s) and material(s), same cover size and material, same dimple patterns, etc.). Also, as used herein, two dimples will be considered to be of different dimple "types" if they differ from one another in at least one of dimple perimeter shape or dimple profile (cross sectional) shape, including but not limited to different dimple depths, different dimple diameters, or different dimple radii. Two dimples will be considered to be of the "same type" if the CAD or other "blueprint" data or specifications for making the mold cavity for forming the dimples indicates that the dimples are intended to have the same size and shape (post mold treatments, such as coating or painting, may slightly alter the dimensions from dimple to dimple within a given dimple type, and these post-molding changes do not convert dimples of the same "type" to dimples of different "types").

Other aspects of this invention are directed to methods for making golf balls including particles to increase micro surface roughness of the ball, e.g., by applying a coating comprising a resin and particles to a surface of a golf ball, by incorporating roughness increasing particles into the cover member, etc.

BRIEF DESCRIPTION OF THE DRAWINGS

A more complete understanding of the present invention and certain advantages thereof may be acquired by referring to the following detailed description in consideration with the accompanying drawings, in which.

Figure 1:
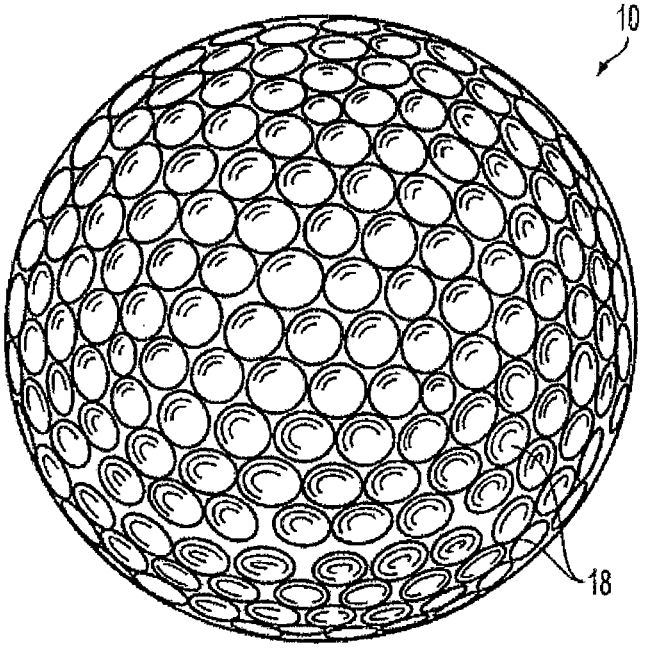
FIG. 1 schematically illustrates a golf ball having dimples.

The reader is advised that the various parts shown in these drawings are not necessarily drawn to scale.

DETAILED DESCRIPTION

In the following description of various example structures, reference is made to the accompanying drawings, which form a part hereof, and in which are shown by way of illustration various example golf ball structures. It is to be understood that other specific arrangements of parts and structures may be utilized and structural and functional modifications may be made without departing from the scope of the present invention. As some more specific examples, aspects of this invention may be practiced on balls having any desired construction, any number of pieces, any specific dimple design, and/or any desired dimple pattern.

A. General Description of Golf Balls and Manufacturing Systems and Methods

Golf balls may be of varied construction, e.g., one-piece balls, two-piece balls, three-piece balls, four-piece balls, five-piece balls, wound balls, etc. The differences in play characteristics resulting from these different types of constructions can be quite significant. Generally, golf balls may be classified as solid or wound balls. Solid balls that have a two-piece construction, typically a cross-linked rubber core, e.g., polybutadiene cross-linked with zinc diacrylate and/or similar cross-linking agents, encased by a blended cover, e.g., ionomer resins, are popular with many average recreational golfers. The combination of the core and cover materials provides a relatively "hard" ball that is virtually indestructible by golfers and one that imparts a high initial velocity to the ball, resulting in improved distance. Because the materials from which the ball is formed are very rigid, two-piece balls tend to have a hard "feel" when struck with a club. Likewise, due to their hardness, these balls have a relatively low spin rate, which also helps provide greater distance.

Wound balls are generally constructed from an encased liquid or a solid center surrounded by tensioned elastomeric material (e.g., tensioned rubber bands) and covered with a durable cover material, e.g., ionomer resin, or a softer cover material, e.g., balata or polyurethane. Wound balls are generally thought of as performance golf balls and have good resiliency, desirable spin characteristics, and good "feel" when struck by a golf club. However, wound balls are generally difficult to manufacture as compared to solid golf balls.

More recently, three-piece and four-piece balls have gained popularity, both as balls for average recreational golfers as well as performance balls for professional and other elite level players. Such balls typically include a core (optionally a multi-part core, such as an inner core and an outer core), one or more mantle or intermediate layers (also called "inner cover" layers), and an outer cover layer.

A variety of golf balls have been designed to provide particular playing characteristics. These characteristics generally include control of the initial velocity and spin of the golf ball, which can be optimized for various types of players. For instance, certain players prefer or need a ball that has a high spin rate in order to optimize launch angle and/or control and stop the golf ball around the greens. Other players prefer a ball that has a low spin rate and high resiliency to maximize distance and/or prevent excessive lift at initial launch.

The carry distance of some conventional two-piece balls has been improved by altering the typical single layer core and single cover layer construction to provide a multi-layer ball, e.g., a dual cover layer, a dual core layer, and/or a ball having an intermediate layer disposed between the cover and the core. Three-piece and four-piece balls (and even five-piece balls) are now commonly found and are commercially available. Aspects of this invention may be applied to all types of ball constructions, including the wound, solid, and/or multi-layer ball constructions described above.

Figure 2:
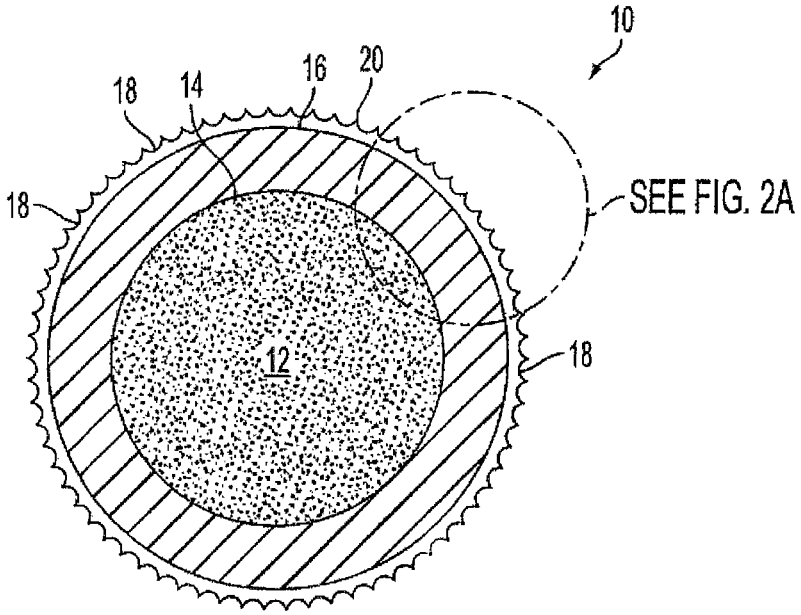
FIGS. 2 and 2A schematically illustrate a cross-sectional view of a golf ball in accordance with FIG. 1 having a coating thereon.
Figure 2A:
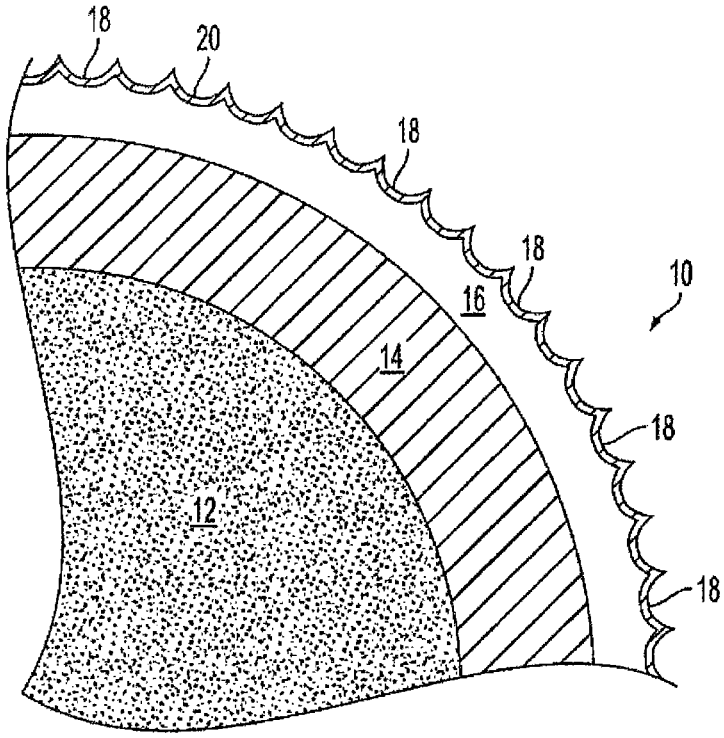

FIG. 1 shows an example of a golf ball 10 that includes a plurality of dimples 18 formed on its outer surface. FIGS. 2 and 2A show an example of a cross section of such a golf ball 10, which has a core 12, an intermediate layer 14, a cover 16 having a plurality of dimples 18 formed therein, and a coating 20 applied over the exterior surface of the golf ball 10. The golf ball 10 alternatively may be only one piece such that the core 12 represents the entirety of the golf ball 10, and the plurality of dimples 18 are formed on the outer surface of the core 12. The ball 10 also may have any other desired construction, including conventional constructions and the various example constructions described herein. The thickness of the coating 20 typically is significantly less than that of the cover 16 or the intermediate layer 14, and by way of example may range from about 8 to about 50 μm. The coating 20 should be substantially uniformly applied to the exterior of the ball (e.g., a substantially uniform thickness) and should have a minimal effect on the depth and volume of the dimples 18. An optional primer or basecoat may be applied to the exterior surface of the cover 16 of the golf ball 10 prior to application of the outermost coating layer 20.

The Center

Some golf balls may be formed, for example, with a center having a low compression, but still exhibit a finished ball COR and initial velocity approaching that of conventional two-piece distance balls. The center may have, for example, a compression of about 60 or less. The finished balls made with such centers may have a COR, measured at an inbound speed of 125 ft./s., of about 0.795 to about 0.815. "COR" refers to "coefficient of restitution," which is determined by dividing a ball's rebound velocity by its initial (i.e., incoming) velocity. Ball COR measurement is performed by firing the golf ball samples out of an air cannon at a vertical steel plate over a range of test velocities (e.g., from 75 to 150 ft/s). A golf ball having a high COR dissipates a smaller fraction of its total energy when colliding with the plate and rebounding therefrom than does a ball with a lower COR.

The terms "points" and "compression points" refer to the compression scale or the compression scale based on the ATTI Engineering Compression Tester. This scale, which is well known to persons skilled in the art, may be used in determining the relative compression of a center or ball.

While the center may have a wide variety of characteristics, in some examples, the center (or core) may have a Shore C hardness of about 40 to about 80. The center may have a diameter of about 0.75 inches to about 1.68 inches. The base composition for forming the center may include, for example, polybutadiene and about 20 to 50 parts of a metal salt diacrylate, dimethacrylate, or monomethacrylate. If desired, the polybutadiene can also be mixed with other elastomers known in the art, such as natural rubber, styrene butadiene, and/or isoprene, in order to further modify the properties of the center. When a mixture of elastomers is used, the amounts of other constituents in the center composition are usually based on 100 parts by weight of the total elastomer mixture. In other examples, the center (or core) may be made from resin materials, such as HPF resins (optionally with barium sulfate included therein), which are commercially available from E.I. DuPont de Nemours and Company of Wilmington, Del.

Metal salt diacrylates, dimethacrylates, and monomethacrylates include without limitation those wherein the metal is magnesium, calcium, zinc, aluminum, sodium, lithium or nickel. Zinc diacrylate, for example, provides golf balls with a high initial velocity in the United States Golf Association ("USGA") standard test.

Free radical initiators often are used to promote cross-linking of the metal salt diacrylate, dimethacrylate, or monomethacrylate and the polybutadiene. Suitable free radical initiators include, but are not limited to, peroxide compounds, such as dicumyl peroxide; 1,1-di(t-butylperoxy) 3,3,5-trimethyl cyclohexane; bis(t-butylperoxy) diisopropylbenzene; 2,5-dimethyl-2,5di(t-butylperoxy) hexane; or di-t-butyl peroxide; and mixtures thereof. The initiator(s) at 100 percent activity may be added in an amount ranging from about 0.05 to about 2.5 pph based upon 100 parts of butadiene, or butadiene mixed with one or more other elastomers. Often the amount of initiator added ranges from about 0.15 to about 2 pph, and more often from about 0.25 to about 1.5 pph. The golf ball centers may incorporate 5 to 50 pph of zinc oxide (ZnO) in a zinc diacrylate-peroxide cure system that cross-links polybutadiene during the core molding process.

The center compositions also may include fillers, added to the elastomeric (or other) composition, to adjust the density and/or specific gravity of the center. Non-limiting examples of fillers include zinc oxide, barium sulfate, and regrind, e.g., recycled core molding matrix ground to about 30 mesh particle size. The amount and type of filler utilized is governed by the amount and weight of other ingredients in the composition, bearing in mind a maximum golf ball weight of 1.620 oz has been established by the USGA. Fillers usually range in specific gravity from about 2.0 to about 5.6. The amount of filler in the center may be lower such that the specific gravity of the center is decreased.

The specific gravity of the center may range, for example, from about 0.8 to about 1.3, depending upon such factors as the size of the center, cover, intermediate layer and finished ball, as well as the specific gravity of the cover and intermediate layer. Other components such as accelerators, e.g., tetra methylthiuram, processing aids, processing oils, plasticizers, dyes and pigments, antioxidants, as well as other additives well known to the skilled artisan may also be used in amounts sufficient to achieve the purpose for which they are typically used.

Intermediate Layer(s)

The golf ball also may have one or more intermediate layers formed, for example, from dynamically vulcanized thermoplastic elastomers, functionalized styrene-butadiene elastomers, thermoplastic rubbers, polybutadiene rubbers, natural rubbers, thermoset elastomers, thermoplastic urethanes, metallocene polymers, thermoset urethanes, ionomer resins, or blends thereof. For example, an intermediate layer may include a thermoplastic or thermoset polyurethane. Non-limiting examples of commercially available dynamically vulcanized thermoplastic elastomers include SANTOPRENE®, SARLINK®, VYRAM®, DYTRON®, and VISTAFLEX®. SANTOPRENE® is a dynamically vulcanized PP/EPDM. Examples of functionalized styrene-butadiene elastomers, i.e., styrene-butadiene elastomers with functional groups such as maleic anhydride or sulfonic acid, include KRATON FG-1901x and FG-1921x, which are available from the Shell Corporation of Houston, Tex.

Examples of suitable thermoplastic polyurethanes include ESTANE® 58133, ESTANE® 58134 and ESTANE® 58144, which are commercially available from the B. F. Goodrich Company of Cleveland, Ohio.

Examples of metallocene polymers, i.e., polymers formed with a metallocene catalyst, include those commercially available from Sentinel Products of Hyannis, Mass. Suitable thermoplastic polyesters include polybutylene terephthalate. Thermoplastic ionomer resins may be obtained by providing a cross metallic bond to polymers of monoolefin with at least one member selected from the group consisting of unsaturated mono- or di-carboxylic acids having 3 to 12 carbon atoms and esters thereof (the polymer contains 1 to 50 percent by weight of the unsaturated mono- or di-carboxylic acid and/or ester thereof). More particularly, low modulus ionomers such as acid-containing ethylene copolymer ionomers, include E/X/Y copolymers where E is ethylene, X is a softening comonomer such as acrylate or methacrylate. Non-limiting examples of ionomer resins include SURLYN® and IOTEK®, which are commercially available from DuPont and Exxon, respectively.

Alternatively, the intermediate layer(s) may be a blend of a first and a second component wherein the first component is a dynamically vulcanized thermoplastic elastomer, a functionalized styrene-butadiene elastomer, a thermoplastic or thermoset polyurethane or a metallocene polymer and the second component is a material such as a thermoplastic or thermoset polyurethane, a thermoplastic polyetherester or polyetheramide, a thermoplastic ionomer resin, a thermoplastic polyester, another dynamically vulcanized elastomer, another a functionalized styrene-butadiene elastomer, another a metallocene polymer or blends thereof. At least one of the first and second components may include a thermoplastic or thermoset polyurethane.

One or more intermediate layers also may be formed from a blend containing an ethylene methacrylic/acrylic acid copolymer. Non-limiting examples of acid-containing ethylene copolymers include ethylene/acrylic acid; ethylene/methacrylic acid; ethylene/acrylic acid/n- or isobutyl acrylate; ethylene/methacrylic acid/n- or iso-butyl acrylate; ethylene/acrylic acid/methyl acrylate; ethylene/methacrylic acid/methyl acrylate; ethylene/acrylic acid/iso-bornyl acrylate or methacrylate and ethylene/methacrylic acid/isobornyl acrylate or methacrylate. Examples of commercially available ethylene methacrylic/acrylic acid copolymers include NUCREL® polymers, available from DuPont.

Alternatively, the intermediate layer(s) may be formed from a blend which includes an ethylene methacrylic/acrylic acid copolymer and a second component which includes a thermoplastic material. Suitable thermoplastic materials for use in the intermediate blend include, but are not limited to, polyesterester block copolymers, polyetherester block copolymers, polyetheramide block copolymers, ionomer resins, dynamically vulcanized thermoplastic elastomers, styrene-butadiene elastomers with functional groups such as maleic anhydride or sulfonic acid attached, thermoplastic polyurethanes, thermoplastic polyesters, metallocene polymers, and/or blends thereof.

An intermediate layer often has a specific gravity of about 0.8 or more. In some examples the intermediate layer has a specific gravity greater than 1.0, e.g., ranging from about 1.02 to about 1.3. Specific gravity of the intermediate layer may be adjusted, for example, by adding a filler such as barium sulfate, zinc oxide, titanium dioxide and combinations thereof.

The intermediate layer blend may have a flexural modulus of less than about 10,000 psi, often from about 5,000 to about 8,000 psi. The intermediate layers often have a Shore D hardness of about 35 to 70. The intermediate layer and core construction together may have a compression of less than about 65, often from about 50 to about 65. Usually, the intermediate layer has a thickness from about 0.020 inches to about 0.2 inches. The golf balls may include a single intermediate layer or a plurality of intermediate layers. In the case where a ball includes a plurality of intermediate layers, a first intermediate layer outside the core (which also may be called an "outer core") may include, for example, a thermoplastic material or a rubber material (synthetic or natural) having a hardness greater than that of the core. A second intermediate layer may be disposed around the first intermediate layer and may have a greater hardness than that of the first intermediate layer. The second intermediate layer may be formed of materials such as polyether or polyester thermoplastic urethanes, thermoset urethanes, and ionomers such as acid-containing ethylene copolymer ionomers. An intermediate layer immediately inside the outer cover layer also may be called an "inner cover."

In addition, if desired, a third intermediate layer (or even more layers) may be disposed in between the first and second intermediate layers. The third intermediate layer may be formed of the variety of materials as discussed above. For example, the third intermediate layer may have a hardness greater than that of the first intermediate layer.

The Cover Layer

A golf ball also typically has a cover layer that includes one or more layers of a thermoplastic or thermosetting material. A variety of materials may be used such as ionomer resins, thermoplastic polyurethanes, balata and blends thereof.

The cover may be formed of a composition including very low modulus ionomers (VLMIs). As used herein, the term "very low modulus ionomers," or the acronym "VLMIs," are those ionomer resins further including a softening comonomer X, commonly a (meth)acrylate ester, present from about 10 weight percent to about 50 weight percent in the polymer. VLMIs are copolymers of an α-olefin, such as ethylene, a softening agent, such as n-butyl-acrylate or iso-butyl-acrylate, and an α, β-unsaturated carboxylic acid, such as acrylic or methacrylic acid, where at least part of the acid groups are neutralized by a magnesium cation. Other examples of softening comonomers include n-butyl methacrylate, methyl acrylate, and methyl methacrylate. Generally, a VLMI has a flexural modulus from about 2,000 psi to about 10,000 psi. VLMIs are sometimes referred to as "soft" ionomers.

Ionomers, such as acid-containing ethylene copolymer ionomers, include E/X/Y copolymers where E is ethylene, X is a softening comonomer such as acrylate or methacrylate present in 0 to 50 weight percent of the polymer, and Y is acrylic or methacrylic acid present in 5 to 35 (often 10 to 20) weight percent of the polymer, wherein the acid moiety is neutralized 1 to 90 percent (usually at least 40 percent) to form an ionomer by a cation such as lithium, sodium, potassium, magnesium, calcium, barium, lead, tin, zinc or aluminum, or a combination of such cations, lithium, sodium and zinc being the most preferred. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate.

To aid in the processing of the cover stock, ionomer resins may be blended in order to obtain a cover having desired characteristics. For this reason, the cover may be formed from a blend of two or more ionomer resins. The blend may include, for example, a very soft material and a harder material. Ionomer resins with different melt flow indexes are often employed to obtain the desired characteristics of the cover stock. SURLYN® 8118, 7930 and 7940 have melt flow indices of about 1.4, 1.8, and 2.6 g/10 min., respectively. SURLYN® 8269 and SURLYN® 8265 each have a melt flow index of about 0.9 g/10 min. A blend of ionomer resins may be used to form a cover having a melt flow index, for example, of from about 1 to about 3 g/10 min. The cover layer may have a Shore D hardness, for example, ranging from about 45 to about 80.

The cover also may include thermoplastic and/or thermoset materials. For example, the cover may include a thermoplastic material such as urethane or polyurethane. Polyurethane is a product of a reaction between a polyurethane prepolymer and a curing agent. The polyurethane prepolymer is a product formed by a reaction between a polyol and a diisocyanate. Often, a catalyst is employed to promote the reaction between the curing agent and the polyurethane prepolymer. In the case of cast polyurethanes, the curing agent is typically either a diamine or glycol.

As another example, a thermoset cast polyurethane may be used. Thermoset cast polyurethanes are generally prepared using a diisocyanate, such as 2,4-toluene diisocyanate (TDI), methylenebis-(4-cyclohexyl isocyanate) (HMDI), or paraphenylene diisocyanate ("PPDI") and a polyol which is cured with a polyamine, such as methylenedianiline (MDA), or a trifunctional glycol, such as trimethylol propane, or tetrafunctional glycol, such as N,N,N',N'-tetrakis(2-hydroxpropyl)ethylene-diamine. Other suitable thermoset materials include, but are not limited to, thermoset urethane ionomers and thermoset urethane epoxies. Other examples of thermoset materials include polybutadiene, natural rubber, polyisoprene, styrene-butadiene, and styrene-propylene-diene rubber.

When the cover includes more than one layer, e.g., an inner cover layer and an outer cover layer, various constructions and materials are suitable. For example, an inner cover layer may surround the intermediate layer with an outer cover layer disposed thereon or an inner cover layer may surround one or a plurality of intermediate layers. When using an inner and outer cover layer construction, the outer cover layer material may be a thermoset material that includes at least one of a castable reactive liquid material and reaction products thereof, as described above, and may have a hardness from about 30 Shore D to about 68 Shore D.

The inner cover layer may be formed from a wide variety of hard (e.g., about 50 Shore D or greater), high flexural modulus resilient materials, which are compatible with the other materials used in the adjacent layers of the golf ball. The inner cover layer material may have a flexural modulus of about 65,000 psi or greater. Suitable inner cover layer materials include the hard, high flexural modulus ionomer resins and blends thereof, which may be obtained by providing a cross metallic bond to polymers of monoolefin with at least one member selected from the group consisting of unsaturated mono- or di-carboxylic acids having 3 to 12 carbon atoms and esters thereof (the polymer contains 1 to 50 percent by weight of the unsaturated mono- or di-carboxylic acid and/or ester thereof). More particularly, such acid-containing ethylene copolymer ionomer component includes E/X/Y copolymers where E is ethylene, X is a softening comonomer such as acrylate or methacrylate present in 0-50 weight percent of the polymer, and Y is acrylic or methacrylic acid present in 5-35 weight percent of the polymer, wherein the acid moiety is neutralized about 1-90 percent to form an ionomer by a cation such as lithium, sodium, potassium, magnesium, calcium, barium, lead, tin, zinc, or aluminum, or a combination of such cations. Specific examples of acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate.

Examples of other suitable inner cover materials include thermoplastic or thermoset polyurethanes, polyetheresters, polyetheramides, or polyesters, dynamically vulcanized elastomers, functionalized styrene-butadiene elastomers, metallocene polymers, polyamides such as nylons, acrylonitrile butadiene-styrene copolymers (ABS), or blends thereof.

Manufacturing Process

While golf balls in accordance with examples of this invention may be made in any desired manner without departing from this invention, including in conventional manners as are known and used in the art, one common technique for manufacturing golf balls is a laminate process. In order to form multiple layers around the center, a laminate is first formed. The laminate includes at least two layers and sometimes includes three layers. The laminate may be formed by mixing uncured core material to be used for each layer and calendar rolling the material into thin sheets. Alternatively, the laminate may be formed by mixing uncured intermediate layer material and rolling the material into sheets. The laminate sheets may be stacked together to form a laminate having three layers, using calender rolling mills. Alternatively, the sheets may be formed by extrusion.

A laminate also may be formed using an adhesive between each layer of material. For example, an epoxy resin may be used as adhesive. The adhesive should have good shear and tensile strength, for example, a tensile strength over about 1500 psi. The adhesive often has a Shore D hardness of less than about 60 when cured. The adhesive layer applied to the sheets should be very thin, e.g., less than about 0.004 inches thick.

Preferably, each laminate sheet is formed to a thickness that is slightly larger than the thickness of the layers in the finished golf ball. Each of these thicknesses can be varied, but all have a thickness of preferably less than about 0.1 inches. The sheets should have very uniform thicknesses.

Figure 8:
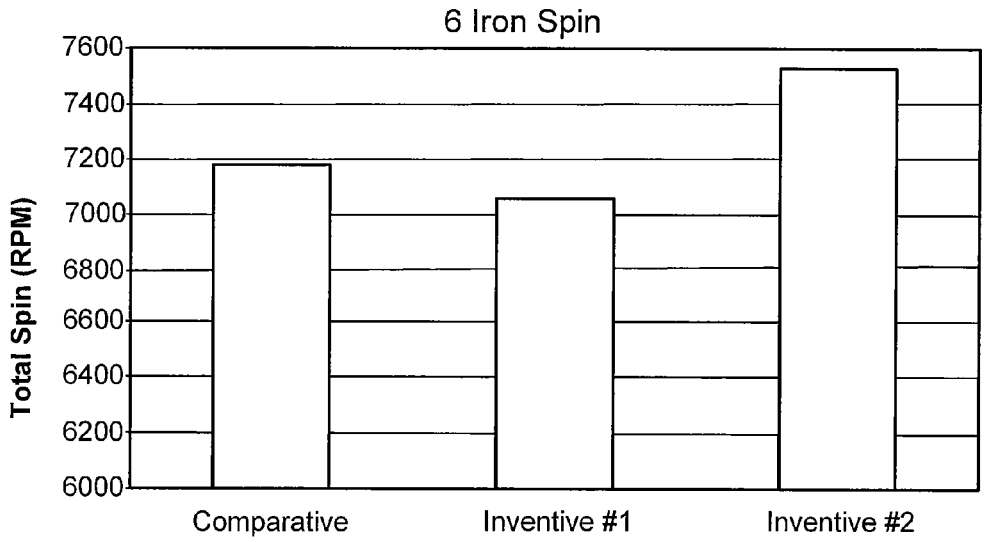
FIG. 8 depicts spin results of golf balls hit using a 6 iron.

The next step in the method is to form multiple layers around the center. This may be accomplished by placing two laminates between a top mold and a bottom mold. The laminates may be formed to the cavities in the mold halves. The laminates then may be cut into patterns that, when joined, form a laminated layer around the center. For example, the laminates may be cut into figure 8-shaped or barbell-like patterns, similar to a baseball or a tennis ball cover. Other patterns may be used, such as curved triangles, hemispherical cups, ovals, or other patterns that may be joined together to form a laminated layer around the center. The patterns may then be placed between molds and formed to the cavities in the mold halves. A vacuum source often is used to form the laminates to the mold cavities so that uniformity in layer thickness is maintained.

After the laminates have been formed to the cavities, the centers are then inserted between the laminates. The laminates are then compression molded about the center under conditions of temperature and pressure that are well known in the art. The mold halves usually have vents to allow flowing of excess layer material from the laminates during the compression molding process. As an alternative to compression molding, the core and/or intermediate layer(s) may be formed by injection molding or other suitable technique.

The next step involves forming a cover around the golf ball core. The core, including the center and any intermediate layers, may be supported within a pair of cover mold-halves by a plurality of retractable pins. The retractable pins may be actuated by conventional means known to those of ordinary skill in the art.

After the mold halves are closed together with the pins supporting the core, the cover material is injected into the mold in a liquid or flowable state through a plurality of injection ports or gates, such as edge gates or sub-gates. With edge gates, the resultant golf balls are all interconnected and may be removed from the mold halves together in a large matrix. Sub-gating automatically separates the mold runner from the golf balls during the ejection of the golf balls from mold halves.

The retractable pins may be retracted after a predetermined amount of cover material has been injected into the mold halves to substantially surround the core. The liquid cover material is allowed to flow and substantially fill the cavity between the core and the mold halves, while maintaining concentricity between the core and the mold halves. The cover material is then allowed to solidify around the core, and the golf balls are ejected from the mold halves and subjected to finishing processes, including coating, painting, and/or other finishing processes, including processes in accordance with examples of this invention, as will be described in more detail below.

B. General Description of Coating Materials

The coating in accordance with at least some examples of this invention comprises a resin and a plurality of particles. The resin may be any suitable resin, non-limiting examples of which include thermoplastics, thermoplastic elastomers, such as polyurethanes, polyesters, acrylics, low acid thermoplastic ionomers, e.g., containing up to about 15% acid, and UV curable systems.

The coating may comprise additional additives incorporated into the resin, such as flow additives, mar/slip additives, adhesion promoters, thickeners, gloss reducers, flexibilizers, cross-linking additives, isocyanates or other agents for toughening or creating scratch resistance, optical brighteners, UV absorbers, anti-yellowing agents, and the like. The amount of such additives usually ranges from 0 to about 5 wt %, often from 0 to about 1.5 wt %, based on total weight of the coating.

In addition, solid particles (e.g., silica) to provide the micro surface roughness may be contained within the resin or adhered to and/or embedded into the surface of resin as described in more detail below.

As another alternative, if desired, the particles for producing the micro roughened surface (as will be described in more detail below) may be incorporated into the cover material 16, and this cover material 16 may be coated with one or more coating layers 20 that may or may not include additional micro roughening particles.

C. General Description of Coating Devices

The coating materials may be delivered by spray guns (either fixed or articulating types). Examples of devices that may be used include heated spray equipment and electrostatic and high volume-low pressure (HVLP) devices. The golf balls are typically placed on work holders, where they rotate and pass through a spray zone in a specified time to obtain full coverage of their exterior surfaces. Additionally or alternatively, if desired, the spray heads that apply the coating material may be movable with respect to the balls and/or articulated to assist in applying a uniform coating to the entire ball structure. Suitable coating systems and methods for use in this invention may include conventional coating systems as are known and used in the art.

In some aspects of this invention, a carrier fluid comprising nitrogen gas or nitrogen-enriched air may be used to deliver the coating material to the exterior surface of the golf ball. Nitrogen is clean and dry (anhydrous) in its elemental gas state. Nitrogen can be ionized to eliminate problems associated with moisture and static electricity.

Suitable equipment for applying coatings using nitrogen-enriched air is described, for example, in U.S. Pat. No. 6,821,315, the disclosure of which is incorporated by reference in its entirety. Such devices are commercially available from N2 Spray Solutions. In general, such devices operate by mixing a carrier fluid under pressure and the coating material. The carrier fluid comprises nitrogen-enriched air, which typically contains about 90-99.5% nitrogen by volume. Nitrogen-enriched air may be produced, for example, by passing air through hollow-fiber membranes as described in the '315 patent.

The temperature of the carrier fluid may be adjusted to optimize coating properties. In general, heating the carrier fluid reduces viscosity and reduces the need for solvents. Reducing viscosity improves flow, aides in atomization, and purges the solvent, resulting in a finer spray with a higher solids content. The carrier fluid may be heated, for example, to a temperature of about 100° F. to about 170° F. (38° C. to 76.6° C.), often from about 150° F. to about 170° F. (65.6° C. to 76.6° C.). Other parameters, such as pressure, also may be suitably adjusted to achieve improved drying characteristics and/or other efficiencies. For example, atomization air pressure of about 40 psi (275.8 kPa) may be employed. U.S. Published Patent Appln. No. 2010/0298069 published Nov. 25, 2010 and entitled "Method and Apparatus for Applying a Topcoat to a Golf Ball Surface" describes systems and methods utilizing nitrogen-containing or nitrogen-enriched delivery fluids to apply coating materials to golf balls. This published patent application is entirely incorporated herein by reference.

D. Specific Examples of Invention

The term "golf ball body" as used herein means a golf ball before applying the top coat (e.g., a ball structure including a core, one or more intermediate layers, and a cover layer with dimples). In terms of the discussion below, the term "coating" often will be used to identify the top coat or last layer applied to the golf ball, but, as also described below, if desired, another coating may be applied over the roughened coating material or roughened cover layer, if desired, provided that an overall micro surface roughened outer surface is still provided. Often the terms "paint" or "painting" may be used synonymously with a "coating" or "coating" process without departing from this invention.

Some aspects of this invention relate to golf balls having a top coat or other coating over the cover layer, wherein this coating comprises a resin having particles contained therein or applied thereon. The particles provide a golf ball having a somewhat roughened surface (e.g., micro-roughened), as will be described in more detail below.

Figure 3:
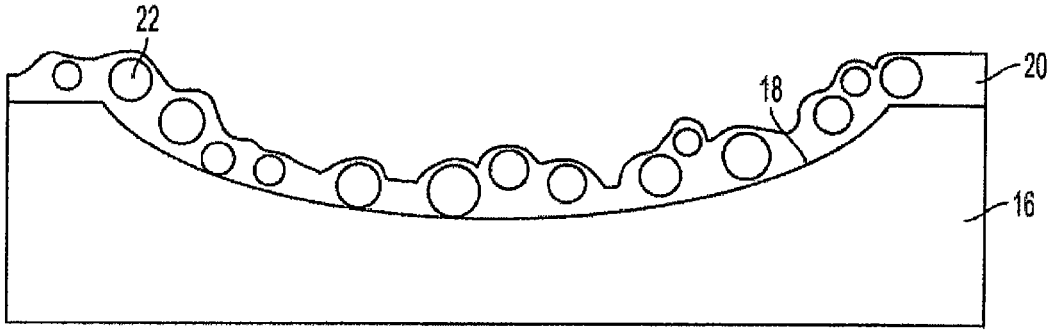
FIG. 3 schematically illustrates a cross-sectional view of a portion of a golf ball having a cover layer and coating in accordance with FIG. 1 having particles contained within a resin.

If the resin contains the particles, after the resin is applied to the golf ball body to form the coating, at least some of the particles may protrude beyond an average thickness of the resin. In some instances, the average size of the particles may be greater than the average thickness of the resin. As shown in FIG. 3, generally the particles 22 protrude from the surface such that a thin portion of the resin 20 still covers the particles. The surface of the ball will therefore be roughened somewhat, as shown in FIG. 3. The coating 20 thickness and surface roughness shown in FIG. 3 is exaggerated to help better illustrate features of this aspect of the invention.

Figure 4:
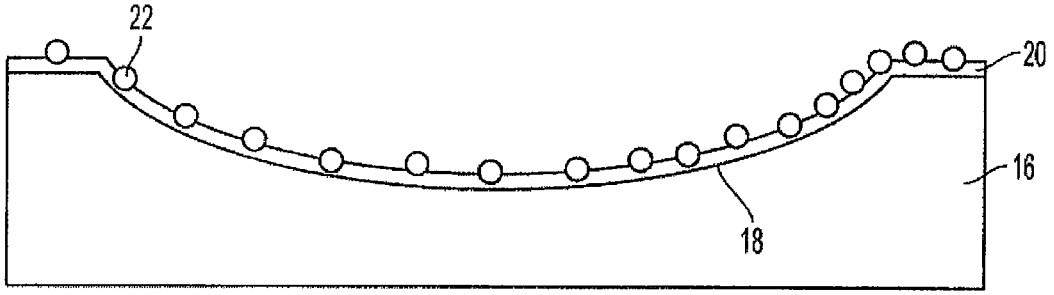
FIG. 4 schematically illustrates a cross-sectional view of a portion of a golf ball having a cover layer and coating in accordance with FIG. 1 having particles applied onto the surface of a resin.

If the resin itself does not contain the particles necessary to provide the roughened surface when it is applied to the golf ball cover 18, after the resin is applied, and prior to drying, particles may be applied to the wet resin. The particles may adhere to and/or become at least partially embedded into the resin, but still extend from the surface of the resin to provide a somewhat roughened surface. As shown in FIG. 4, in this example structure and method, particles 22 are applied to the surface of resin 20. Again, the sizes shown in FIG. 4 are exaggerated to help better illustrate features of this aspect of the invention.

If desired, the features of FIGS. 3 and 4 may be combined into a single ball construction. More specifically, if desired, after the coating process of FIG. 3, additional particles may be adhered to the coating 20 in a process like that shown and described above in conjunction with FIG. 4. The additional step of post coating particle adherence (e.g., like that of FIG. 4) may be selectively applied to certain areas of the ball (e.g., areas where lower than desired roughness is observed) or may be applied to specific predetermined areas of the ball (e.g., at the poles, at the seam, at areas covered or "shadowed" by a holding device during an initial coating process, etc.). Additionally or alternatively, if desired, as noted above, roughening particles 22 may be included in the cover layer 16, in at least some examples of this invention. In such arrangements and methods, the coating 20 should not be applied so thick as to completely smooth out the areas between particles 22 in the cover 16 (i.e., so that sufficient micro surface roughness continues to exist in the final product).

The particles 22 allow for fine tuning of and/or improvement to the aerodynamic performance of golf balls in flight, e.g., to enable longer flights of the golf ball, better lift, etc. The particles cause the finish of the coating to be rougher and on a micro-scale act as small dimples, which is believed to increase the turbulence in the air flow around the ball and reduce flow separation on the golf ball, thereby reducing pressure drag. Also, if desired, the durability of the golf ball may be improved both in cut resistance and abrasion resistance, e.g., depending on the properties of and/or materials used in the coating 20.

Given the general description of various example aspects of the invention provided above, more detailed descriptions of various specific examples of golf ball structures according to the invention are provided below.

II. Detailed Description of Example Golf Balls and Methods According to Aspects of the Invention The following discussion and accompanying figures describe various example golf balls in accordance with aspects of the present invention. When the same reference number appears in more than one drawing, that reference number is used consistently in this specification and the drawings to refer to the same or similar parts throughout.

As described above, FIG. 3 and FIG. 4 illustrate aspects of the invention related to golf balls having a top coat or other coating comprising resin and particles contained within the resin or applied and/or embedded thereon, respectively.

The particles may be of any shape and may be regular, irregular, uniform, non-uniform, or mixtures thereof. The particles may be any polygon or other geometric shape, including regular shapes, such as spheres or cubes. The spheres may have a round cross-section or may be flattened to provide an elongated or oval cross-section. The cubes may be of square or rectangular cross-section. Irregular shapes may be defined by an irregular surface, an irregular perimeter, protrusions, or extensions. The particles may be rounded, elongated, smooth, rough, or have edges. Combinations of different shapes of particles may be used. Crystalline or regular particles, such as tetrapods, may also be used.

Particles may be made from any material known in the art, such as organic or inorganic, plastics, composite materials, ceramics, and metals. Suitable particles include, but are not limited to, amorphous particles, such as silicas, and crystalline particles, such as metal oxides, e.g., zinc oxide, iron oxides, or titanium oxide. As additional examples, particles may comprise fumed silica, amorphous silica, colloidal silica, alumina, colloidal alumina, titanium oxide, cesium oxide, yttrium oxide, colloidal yttria, zirconia, colloidal zirconia, polyethylene terephthalate, polybutylene terephthalate, polyethylene naphthalate, vinyl esters, epoxy materials, phenolics, aminoplasts, polyurethanes and composite particles of silicon carbide or aluminum nitride coated with silica or carbonate.

The particles may be selected to provide a desired level of micro surface roughness to the golf ball to achieve the desired aerodynamic qualities of the golf ball, as well as to optionally improve abrasion resistance. The particles may by of any suitable hardness and durability. Softer particles tend to affect spin, for example.

The average size of the particles may depend on various factors, such as the material selected for the particles. Generally, the particle sizes will range from 400 nm to 40 microns, and in some example constructions, from 5 to 20 microns. In one particular example, the particle sizes range from 8 to 12 microns. The particles may be approximately the same size or may be different sizes, optionally within the defined ranges. If the particles are applied to the surface of the resin (e.g., as in FIG. 4), they would generally be smaller than if they were contained within the coating (e.g., as in FIG. 3).

Any suitable resin may be used including thermoplastics, thermoplastic elastomers such as polyurethanes, polyesters, acrylics, low acid thermoplastic ionomers, e.g., containing up to about 15% acid, and UV curable systems. Specific examples include AKZO NOBEL 7000A103. Paints and topcoats of the types conventionally known and used in golf ball production (e.g., as coating layer 20) may be used as the base resin to contain roughening particles without departing from this invention.

Additional additives optionally may be incorporated into the resin, such as flow additives, mar/slip additives, adhesion promoters, thickeners, gloss reducers, flexibilizers, cross-linking additives, isocyanates or other agents for toughening or creating scratch resistance, optical brighteners, anti-yellowing agents, UV absorbers, and the like. The amount of such additives usually ranges from 0 to about 5 wt %, often from 0 to about 1.5 wt %.

The viscosity of the resin prior to application to the golf ball body may be about generally 16 to 24 seconds as measured by #2 Zahn cup. Generally the resin is thin enough to easily spray the coating onto the golf ball body, but thick enough to prevent the resin from substantially running after application to the golf ball body.

The thickness of the applied resin (after drying) typically ranges from of about 8 to about 50 μm, and in some examples, from about 10 to about 15 μm. When the particles are contained within the resin, the thickness of the resin may be less than the particle size in order to allow at least some of the particles to protrude from the resin.

The coating contains a plurality of particles, generally, 0.1 to 30 wt % particles based on total coating weight, and in some examples, from 3 to 10 wt %.

The coating may be clear or opaque and may be white or have a tint or hue or other coloring pigment. The particles may be of any color. Generally application of the coating and particles to the outside of the golf ball, if present in a sufficient amount, will give the ball somewhat of a dull or matte finish, as compared to the brighter or shinier finish of many conventional golf balls. The particles tend to diffuse some of the light in a clear coat, for example.

According to one aspect of the present invention, a coating is formed by applying and drying a resin on the surface of the golf ball body. The method of applying the resin is not limited. For example, a two-component curing type resin such as a polyurethane may be applied by an electrostatic coating method, or by a spray method using a spray gun, for example, after mixing an aqueous polyol liquid with a polyisocyanate. In the case of applying the coating with the spray gun, the aqueous polyol liquid and the polyisocyanate may be mixed bit by bit, or the aqueous polyol liquid and the polyisocyanate are fed with the respective pumps and continuously mixed in a constant ratio through the static mixer located in the stream line just before the spray gun. Alternatively, the aqueous polyol liquid and the polyisocyanate can be air-sprayed respectively with the spray gun having the device for controlling the mixing ratio thereof. Subsequently, the two-component curing type urethane resin on the surface of the golf ball body is dried.

In one aspect, the coating comprises resin (with any additives) and particles mixed therein. The coating is applied to the golf ball body such as described above. Prior to application to the golf ball body, the particles may be added to the resin as a separate ingredient, or may be pre-mixed with one of the components in a two-component coating composition.

In another aspect, a resin layer (with any additives) is applied to the golf ball body such as described above. Prior to drying, particles are applied to the top of the wet resin layer using a media blaster, sand blaster, powder coating device, or other suitable device. The particles may adhere to the surface and/or be embedded into the surface of the resin layer.

In another aspect, a very thin resin layer may be applied on top of the particles to hold the particles in place. Generally this resin layer is composed of the same resin layer initially applied, but may have a thinner viscosity. This additional thin layer of resin may be provided, if necessary or desired, to fine tune or somewhat reduce the exterior surface roughness of the ball.

Examples

Golf balls were prepared with the following coatings and then tested for various properties

- Inventive #1—Polyurethane Clear Coat with 5% to 10% by weight small silica particles (1 μm to 500 nm). Smooth appearance.
- Inventive #2—Polyurethane Clear Coat with 5% to 10% by weight large silica particles (1 μm to 5 μm). Rough, matte appearance.
- Comparative—Standard Polyurethane Clear Coat with no added silica particles.

Figure 5:
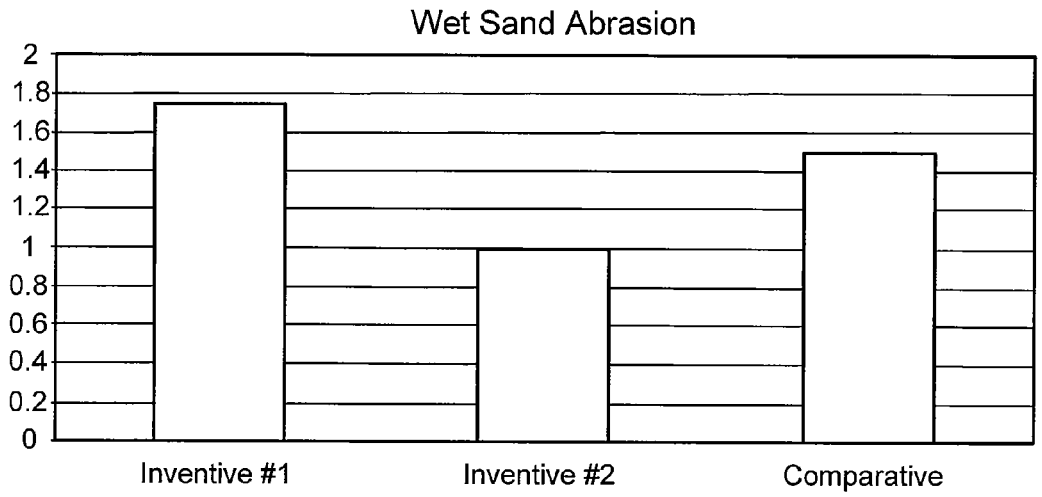
FIG. 5 depicts test results for Wet Sand Abrasion.

In the Wet Sand Abrasion test, balls were tumbled in wet sand for 8 hrs. The balls were compared visually. Lower scores indicated less damage to the ball. The balls were graded from 1 to 5 with 1 being the best and 5 being the worst. Attention is drawn to FIG. 5, which shows that Inventive Sample #2 had a lower (better) wet sand abrasion score as compared to that of the Comparative Sample.

Figure 6:
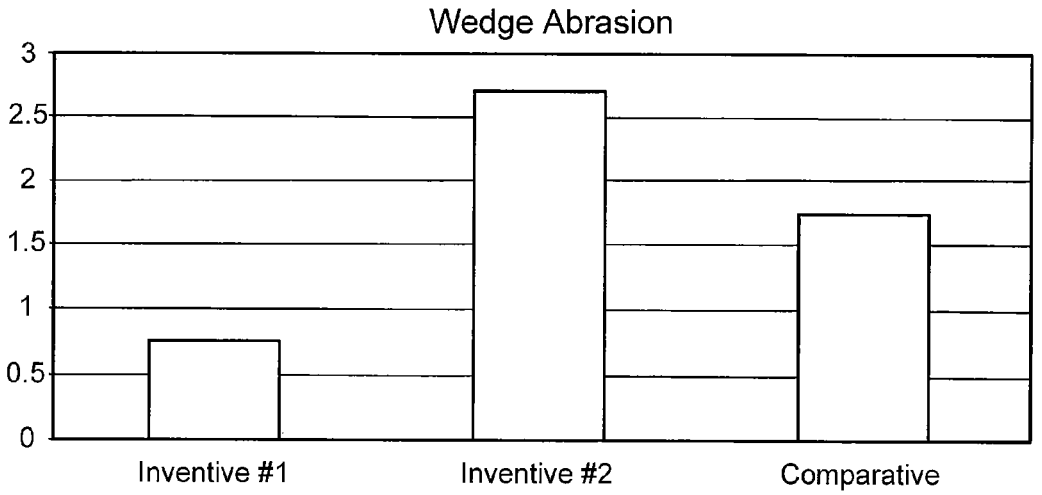
FIG. 6 depicts test results for Wedge Abrasion.

In the Wedge Abrasion test, balls were hit with a standard 56 deg. wedge and the degree of scuffing was visually analyzed. Lower scores again indicated less damage to the ball. The balls were graded from 1 to 5 with 1 being the best and 5 being the worst. Attention is drawn to FIG. 6, which shows that Inventive Sample #1 had a lower (better) wedge abrasion score as compared to that of the Comparative Sample.

Figure 7:
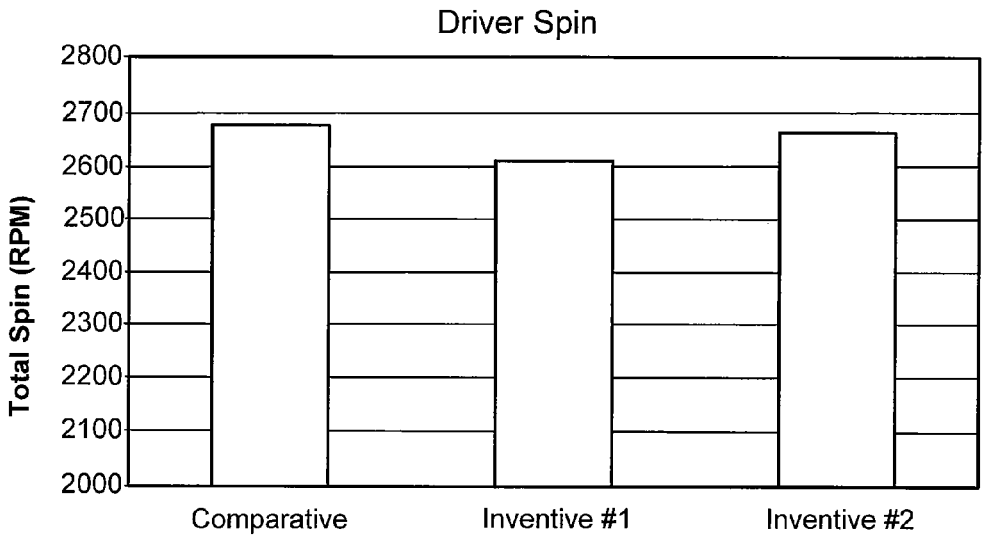
FIG. 7 depicts spin results of golf balls hit using a driver.
Figure 9:
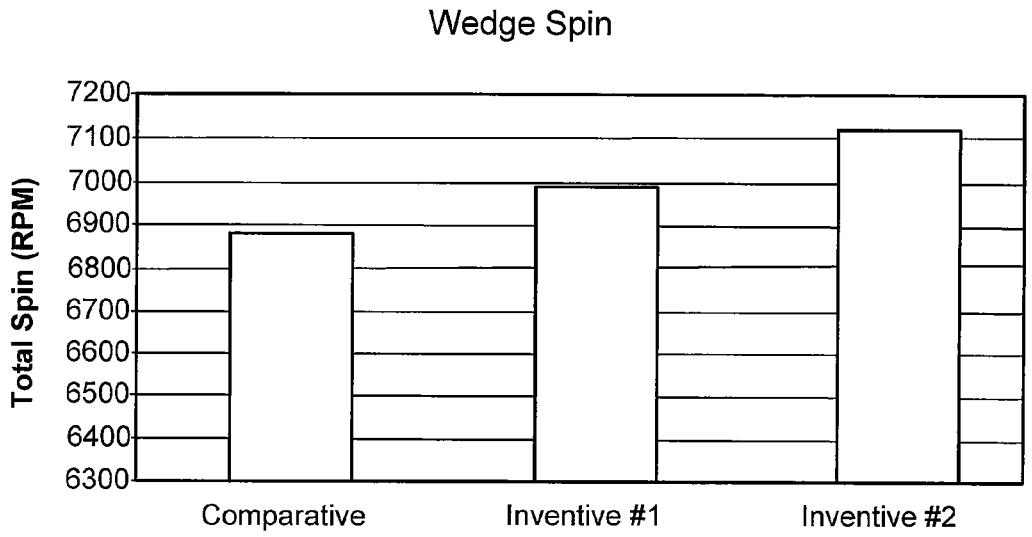
FIG. 9 depicts spin results of golf balls hit using a wedge.

The spin graphs (FIGS. 7-9) show the inventive coating can increase spin somewhat off of irons and wedges without increasing driver spin. This is advantageous for more distance and control off the driver (lower spin) and more control around the green (higher spin).

Aerodynamic Data

Golf balls in accordance with examples of this invention were subjected to various aerodynamic tests as described in more detail below.

In the following evaluation, the "surface roughness" (also called "Ra" in this specification) of various balls was evaluated. Surface roughness may be thought of as the arithmetic average of deviation from an ideal surface, and it may be calculated according to the following formula:

$$R_a = 1/n\sum_{i=1}^{n} |y_i|$$

where y represents the height of the surface's deviation from an "ideal surface" at a specific location and "n" represents the number of height deviation measurements made on the surface. The ideal surface may be defined as the location of the perfectly smooth surface without roughness or height deviations, e.g., the average surface location over the area measured. In at least some instances, the ideal surface may be defined by a "best fit" curve derived from a three-dimensional surface scan of the ball's surface (described in more detail below) and/or derived at least in part from CAD data representing the surface of the mold cavity from which the ball cover is formed (optionally taking into account the additional thickness provided by any post-mold coating(s)).

Figure 10A:
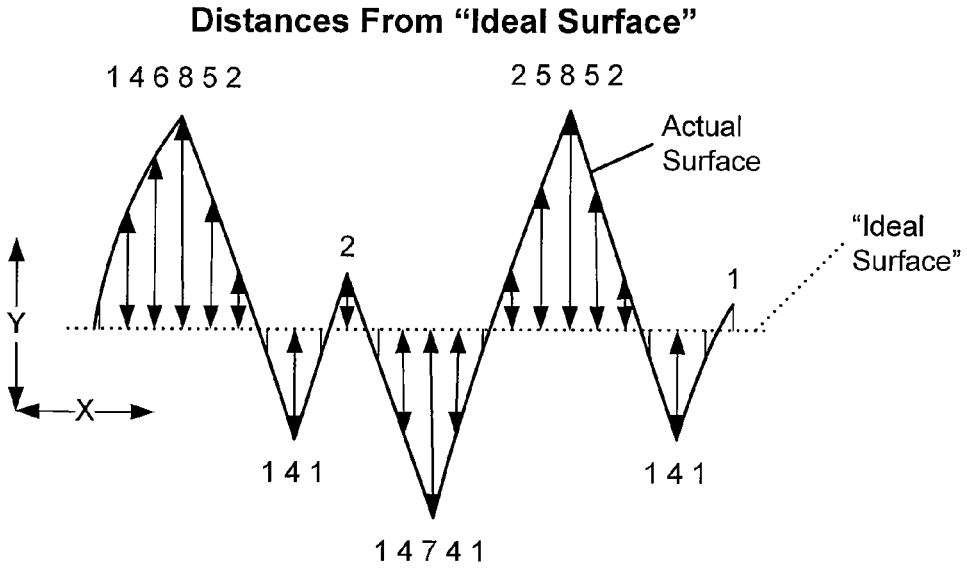
FIG. 10A is a diagram used in explaining measurement of surface roughness and deviation of an actual surface from an "ideal" surface.

Height deviation measurements may be made in any desired number and/or at any desired spacing around a ball without departing from this invention. FIG. 10A provides an example of the manner in which height deviation and surface roughness may be measured. In this example, while an ideal, smooth surface is illustrated (which may be flat or curved, e.g., corresponding to the curvature of a "perfect" ball or a "perfect" dimple, shown as a broken line in FIG. 10A), the actual surface (the solid line) is shown to have peaks and valleys. Measurements of the actual surface location with respect to the ideal surface location are made at constant spaced distances across the desired surface area (e.g., the entire surface of the ball, at selected locations around the ball surface, within or around one or more dimples, on one or more land areas, etc.), and that measured distance corresponds to the height in the "y" direction that the actual surface deviates from the ideal surface at that specific location. Then, the sum of the absolute values for these height deviations at all measured actual surfaces is divided by the total number of measurements taken to thereby provide an average roughness value for the ball ("Ra"), e.g., as indicated from the formula above.

Appropriate measurements of the change in the surface height (e.g., height deviations) may be made using three-dimension scanning systems as are known and commercially available (e.g., a system including a Hirox OL-350II lens, a Hirox KH-1300 microscope (available from Hirox-USA, Inc., River Edge, N.J.), a COMS Remote Controller CP-3R, Hirox KH-1300 Microscope Controller, COMS Position Controller CP-310, and a COMS CD-3R_MMMB Amplifier) . Such systems are capable of making three-dimensional models of an object being scanned.

As a more specific example, a three-dimension scanning system, like that described above, may be programmed to take about 4900 "pictures" around the area of a single dimple. More specifically, for a single dimple, 70 sub-pictures may be made (e.g., with a tiling factor (picture overlap) of 25%) over the surface area of the dimple (a 7×10 matrix of pictures) and its immediately surrounding area, and each sub-picture includes 70 pictures in the vertical direction (to locate the surface in the depth direction). These pictures (and subpictures) allow for computerized reconstruction of a representation of the actual dimple surface.

Another term used in this specification is called "micro surface roughness." "Micro surface roughness" is simply the Ra value described above, but only counting deviations from the ideal surface of 0.25 mm or smaller (although other cutoff values may be used without departing from this invention). This parameter may be referred to herein as $Ra_x$, wherein "x" represents the desired upper limit of deviation considered to constitute "micro" surface roughness. Thus, deviations from the ideal surface location of 0.25 mm or less may be referred to herein as $Ra_{0.25}$, deviations from the ideal surface of a height of 0.3 mm or less may be referred to herein as $Ra_{0.3}$, etc. The sum of all surface roughness (e.g., with no upper limit or cut off height, with a cut off height of 80 mm, etc.) also is referred to in this specification as "macro surface roughness." Thus, "micro surface roughness" may be thought of as the portion of overall or macro surface roughness contributed by height deviations of 0.25 mm or less (or other desired upper limit, as noted above).

Any desired manner of measuring surface roughness and/or deviation of an actual surface from an "ideal surface" may be used without departing from this invention to determine both "macro surface roughness" and "micro surface roughness," although the three-dimensional scanning system described above was used in the tests described below.

In these experiments, a golf ball model having a smooth exterior coating was used as the control ball. This ball model had a three piece construction with a thermoplastic polyurethane cover. For the inventive balls, the same ball construction, dimple pattern, and materials were used, except silica particles were incorporated into the polyurethane clear coat applied to the balls such that the balls had a rough, matte appearance (the control balls have this same type of coating without the additional silica particles added thereto).

Figure 10B:
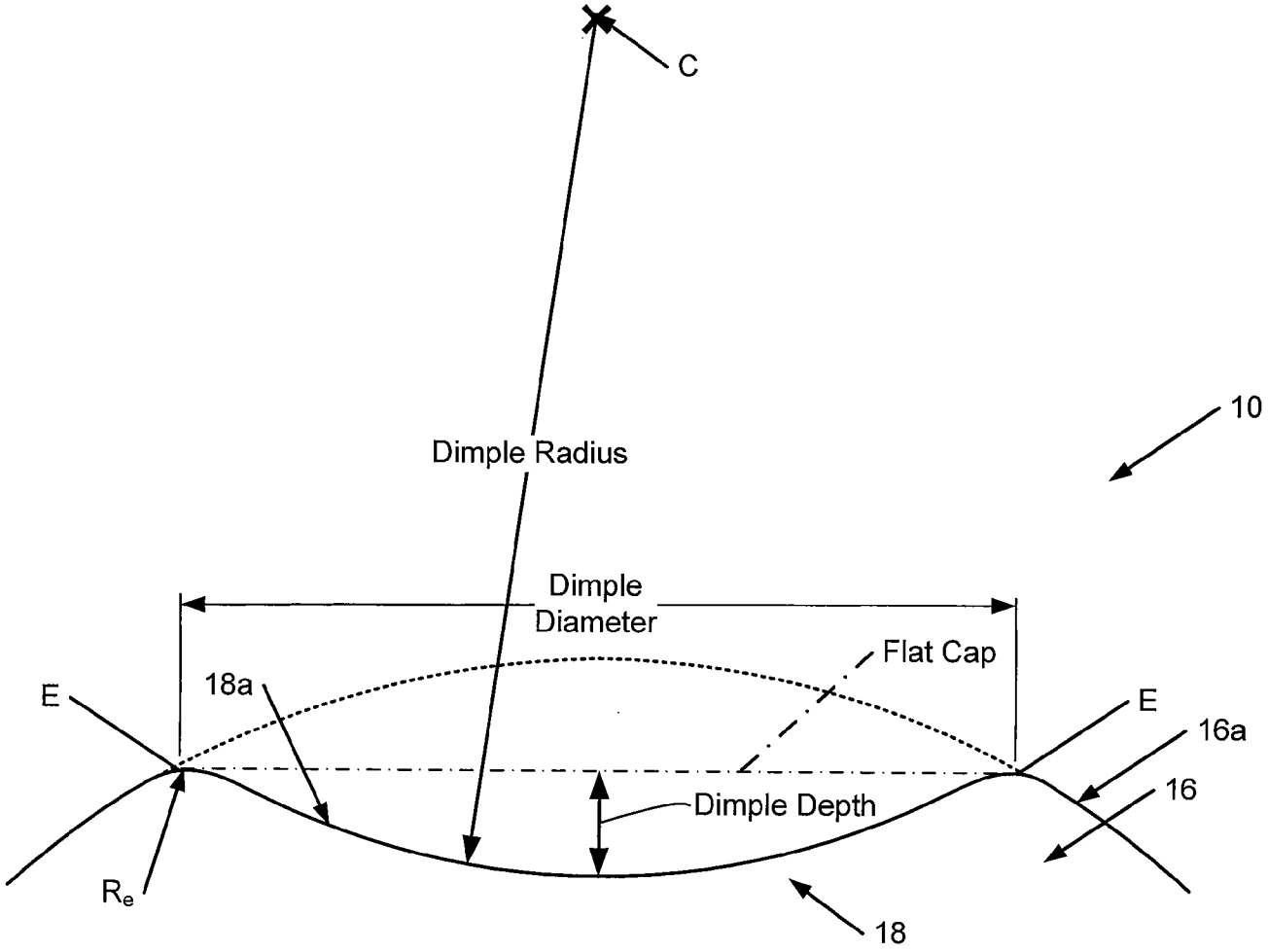
FIG. 10B is a diagram used in explaining various dimple parameters of a golf ball in accordance with this invention.

FIG. 10B provides an illustration that helps to explain certain dimple properties as those terms are used in this specification. FIG. 10B illustrates a partial cross-sectional view of a portion of a golf ball cover layer 16 with a dimple 18 formed in it prior to coating (the other layers of the ball and the coating are omitted to improve clarity). The partial cross-sectional view of FIG. 10B is taken at a center of dimple 18 that has a round outer perimeter surface edge shape (when looking directly down at the dimple 18 on the ball's surface). As shown in FIG. 10B, the majority of this example dimple 18 has a circular arc cross-sectional shape. Thus, the dimple 18 is said to have a "dimple radius," wherein the center C of this dimple radius is located outside of the ball 10.

Dimples 18 in accordance with at least some examples of this invention may have a sharp or abrupt corner at the junction of the surface 16*a* of the cover layer 16 and the interior surface 18*a* of the dimple 18. Often, however, as shown in FIG. 10B, the dimple edge will be more rounded, e.g., having an edge radius $R_e$. While any desired edge radius may be provided in dimple constructions in accordance with examples of this invention, in some more specific examples, the edge radius $R_e$ will be in the range of 0.1 to 5 mm, and in some examples, within the range of 0.25 to 3 mm or even within the range of 0.25 to 1.5 mm. Such dimples 18 may still be considered to have a spherical sector shape and a circular arc cross sectional shape even when the extreme edges of the dimple 18 have a different shape (such as a rounded corner or edge) to facilitate transition between the interior dimple surface 18*a* and the outermost cover layer surface 16*a*.

In dimples 18 of the type illustrated in FIG. 10B, the dimple has no clear cut beginning or edge. Thus, as used in this specification, the edge (or perimeter) of the dimple 18 may be determined by locating the points E at which tangents at the exact opposite sides of the dimple 18 are parallel (to thereby provide the single dot-dash line shown in FIG. 10B labeled "Flat Cap"). These tangent points can be located, in effect, by laying a "flat cap" down over the dimple and finding the location on the ball surface on which this cap rests (e.g., using CAD representations of dimples). These tangent points E define the dimple 18 edge E, and for dimples having a round perimeter edge, the distance between the opposite tangent points E is defined as the dimple's "diameter" as that term is used in this specification. For dimples having other perimeter shapes (such as polygons, ellipses, ovals, etc.), a similar dimple dimensional size may be defined, such as length, width, major axis, minor axis, major radius, minor radius, chord length, diagonal length, etc.

The dimple's "depth," as used in this specification, means the dimension of the dimple from its deepest point to the tangent "flat cap" line, as shown in FIG. 10B. For spherical sector dimples having a circular arc cross sectional shape, this dimple "depth" will be measured at the geometric center of the dimple 18, from the flat cap line to the dimple interior surface 18*a* at the dimple 18's center.

The control golf balls (including their "smooth" polyurethane clear coat) were used in these tests and similar balls, but with the rough exterior clear coat (including silica roughening particles) were used (Inventive Balls #2 described above). Two of the control balls weighed 45.3559 g and 45.3883 g, respectively, and two of the balls treated in accordance with this invention weighed 45.7568 g and 45.7448 g, respectively. A Mettler Toledo scale was used for the weight measurements. While the roughened balls were on average 0.379 grams heavier than the smooth balls (0.8% heavier), this difference is believed to have a negligible effect on the comparative trajectories of these two types of balls (as estimated by the estimation model provided by Bissonnette, et al., in U.S. Pat. No. 6,729,976, which patent is entirely incorporated herein by reference).

Any desired amount of the surface area of the ball may be measured to determine the surface roughness (both micro and macro) for the ball. Preferably, measurements will be made over sufficient areas dispersed around the ball to provide an adequate sampling so that the determined roughness values can be statistically attributed to the entire ball. For these experiments, multiple dimples of each dimple type on the ball were measured (including the dimple itself and a portion of its surrounding area), and each of the measured dimples was measured two or three times. The average of the surface roughness measurements for the multiple measurements of each dimple was used as the result for that dimple. This procedure resulted in the measurement of 36 total dimples (each measured 2 or 3 times, as noted above), and the measured locations were dispersed around the golf ball surface.

In some example surface roughness measuring tests for this invention, the roughness of at least 7.5% of the ball's overall surface area will be measured, optionally in at least 36 discrete areas dispersed around the ball surface, and this measured surface roughness will be considered the surface roughness of the entire ball. For some measurement techniques, the discrete areas will be centered on or fully contain a dimple, and measurements will be made on at least six different dimples of each size (provided that the ball has at least six dimples of each size, and if not, all dimples of that size will be measured). The dimples measured should be dispersed around the ball (e.g., dimples on opposite sides or hemispheres of the ball) so as to provide a good overall estimate of the surface roughness. Dimples are considered to be of the "same size" if the dimples are intended to have the same size and shape after they are molded (e.g., the same perimeter shape, profile shape, depth, height, diameter, diameter to depth ratio, etc.) and before coating takes place. Dimples will be considered to be of the "same size" if the CAD or other "blueprint" data for making the mold cavity for forming the dimples indicates that the dimples are intended to have the same size and shape.

Figure 11A:
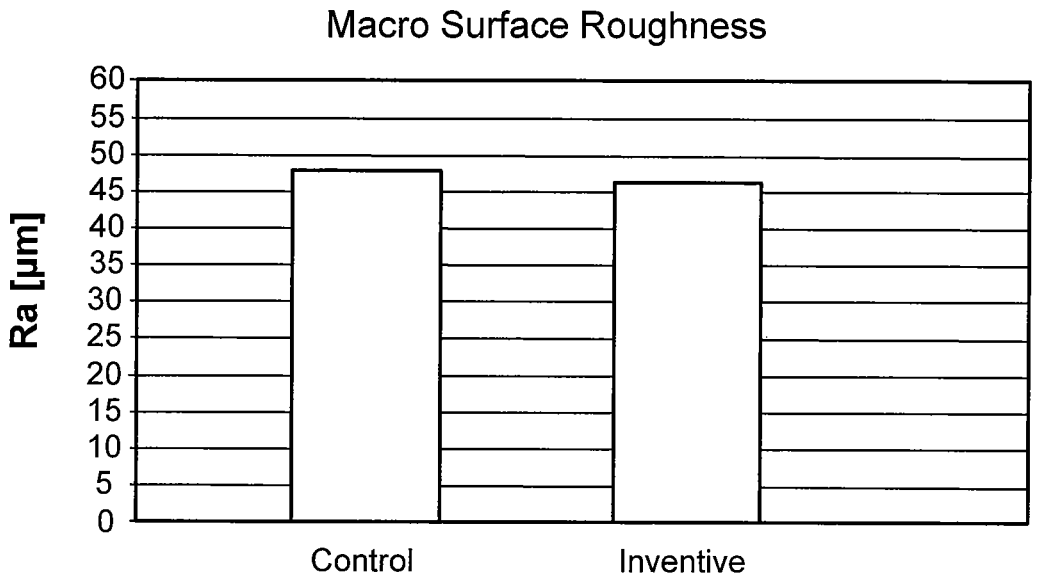
FIG. 11A through 11D are charts illustrating macro surface roughness and micro surface roughness features for various dimples of: (a) roughened balls in accordance with examples of this invention and (b) smooth control balls.
Figure 11B:
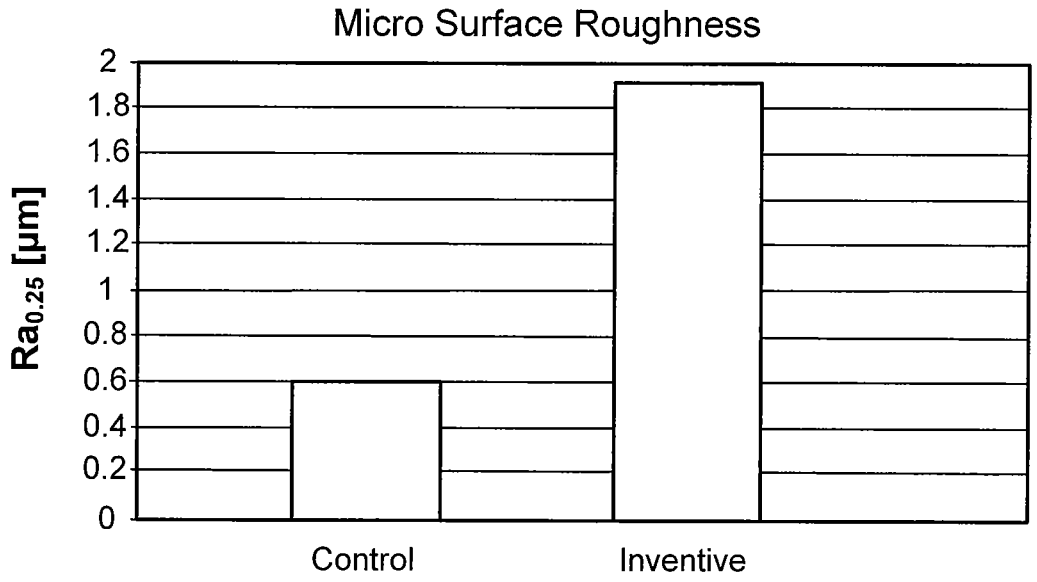

The macro and micro surface roughnesses of the control balls and the inventive balls were measured using scanning equipment as described above, and the measurement results for one dimple size are shown in FIGS. 11A and 11B. As shown in FIG. 11A, the macro surface roughness Ra is substantially the same for both balls (each having an $Ra_{80mm}$ of about 46 to 47 μm). This stands to reason because the ball's dimples constitute the main contributor to macro surface roughness as the ball's overall surface roughness is dominated by the presence of the dimples (i.e., the overall surface roughness contribution due to the microparticles is small as compared to the overall surface roughness contribution due to the much larger dimples). Notably, however, as shown in FIG. 11B, the dimples on the two ball types have significantly different micro surface roughnesses ($Ra_{0.25mm}$, in this example). The noted dimples of the smooth, control balls had a micro surface roughness of about 0.6 μm, while the corresponding dimples of the balls including the silica particles to roughen their surface have a micro surface roughness of about 1.9 μm.

Figure 11C:
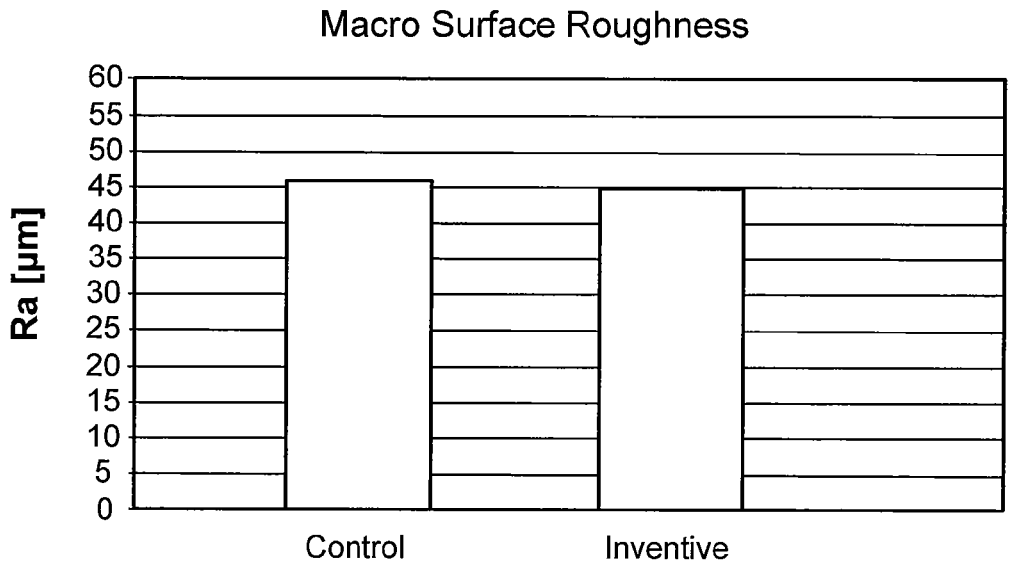
Figure 11D:
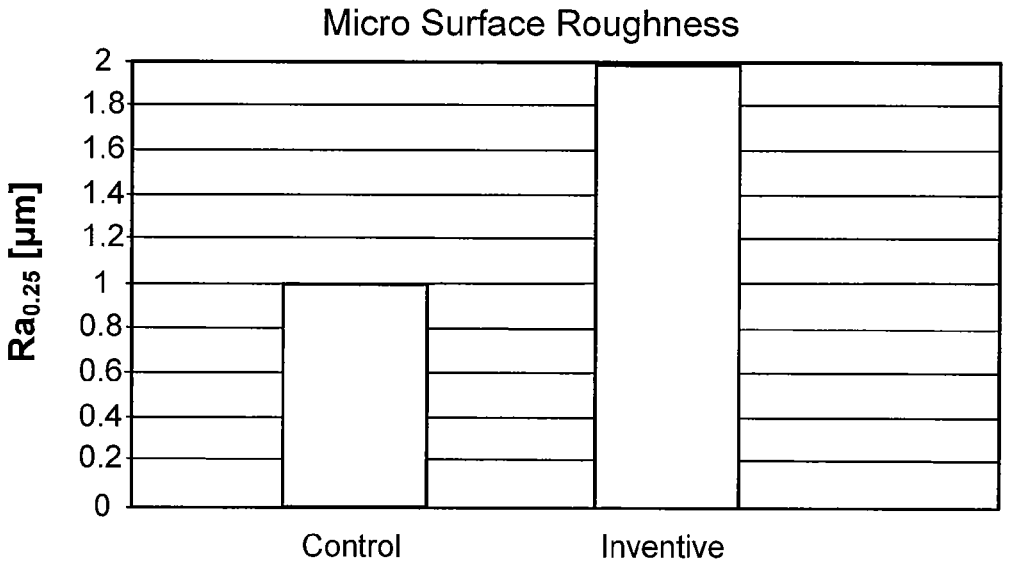

Additionally, the macro and micro surface roughnesses of another dimple type of the control balls and the inventive balls were measured, and the measurement results are shown in FIGS. 11C and 11D. As shown in FIG. 11C, the macro surface roughness Ra is substantially the same for both balls (each having an $Ra_{80mm}$ of about 45 to 46 μm). Notably, however, as shown in FIG. 11D, these dimples on the two ball types have significantly different micro surface roughnesses ($Ra_{0.25mm}$, in this example). The noted dimples of the smooth, control balls had a micro surface roughness of about 1.0 μm, while the corresponding dimples of the balls including the silica particles to roughen their surface have a micro surface roughness of about 1.96 μm.

The following Table provides the average micro and macro surface roughnesses as measured for the various dimple types on the control "smooth coated" ball and on the inventive "rough coated" ball:

TABLE 1

MACRO AND MICRO SURFACE ROUGHNESS MEASUREMENTS

| Dimple Type | Roughened Ball - Micro Surface Roughness [μm] $Ra_{0.25\ mm}$ | Control Ball - Micro Surface Roughness [μm] $Ra_{0.25\ mm}$ | Roughened Ball - Macro Surface Roughness [μm] $Ra_{80\ mm}$ | Control Ball - Macro Surface Roughness [μm] $Ra_{80\ mm}$ |
|---|---|---|---|---|
| A | 1.90 | 0.76 | 44.83 | 46.97 |
| B | 2.25 | 0.88 | 41.78 | 36.04 |
| C | 2.19 | 0.76 | 35.64 | 37.70 |
| D | 2.38 | 0.59 | 45.71 | 46.14 |
| E | 1.90 | 0.60 | 46.10 | 47.30 |
| F | 1.96 | 1.00 | 44.91 | 45.90 |
| Ave | 2.10 | 0.77 | 43.2 | 43.3 |

Thus, the roughened ball had more than 1.75 times the micro surface roughness ($Ra_{0.25mm}$) as compared to the same ball construction without a roughened final coating (e.g., without silica particles provided in and/or adhered to the polyurethane clear coat), while the macrosurface roughness remained relatively constant. For some of the measured dimples, the roughened ball had more than 2 times and even more than 3 times the microsurface roughness as compared to its smooth counterpart. As noted above, as used herein, balls will be considered to have the "same ball construction" if they are made to the same construction specifications with the exception of the roughening material incorporated into the structure (e.g., same core size and materials, same intermediate layer(s) size(s) and material(s), same cover size and material, same dimple patterns (positions and sizes), etc.).

At least some advantageous aspects of this invention (as will be described in more detail below) may be realized for roughened balls that have at least 1.75 times the micro surface roughness ($Ra_{0.25mm}$) as the same ball construction without a roughened final coating, and in some examples, in balls having at least 2 times the micro surface roughness ($Ra_{0.25mm}$) or even at least 2.5 or 3 times the surface roughness ($Ra_{0.25mm}$). Micro surface roughness may be measured in any desired manner, provided it is measured consistently on the two ball surface's being compared and is capable of measuring height deviations less than or equal to the desired micro surface roughness limit. Also, the three-dimensional scanning process described above may be used for measuring dimple micro and macro surface roughnesses.

The dimple scanning process described above found that, for dimples of the same type (e.g., comparing the measured E dimples noted above), the roughened (inventive) ball had slightly deeper dimples (on average) as compared to the smooth (control) ball (e.g., about 158 μm v. 150 μm, respectively, for Dimple Type E and about 152 μm v. 146 respectively, for Dimple Type F). Typically, for dimples of a common diameter (with other factors being equal), shallower dimples (and an increased dimple diameter to depth ratio) will lead to higher trajectories. See, T. Sajima, et al., "The Aerodynamic Influence of Dimple Design on Flying Golf Ball" in Springer (ed.) Engineering of Sport 6, pp. 143-148, which article is entirely incorporated herein by reference. From this "conventional wisdom," due to its somewhat deeper dimples, if any ball trajectory change is noted, one would expect the roughened (inventive) ball to have a lower trajectory as compared to its smooth (shallower dimpled) counterpart control ball. As shown in the ITR data described below, however, the roughened ball in accordance with this invention in fact had a higher trajectory than is smooth counterpart.

The aerodynamic performances of the golf balls were tested using an Indoor Test Range ("ITR") corresponding to that used by the United States Golf Association ("USGA") for testing golf balls for conformance with USGA rules. This equipment and the USGA testing procedures are commonly known and used in the golf ball art, so further detailed description will be omitted. This system is capable of measuring and/or determining the non-dimensional parameters of Reynolds number ("Re") and Spin Ratio (S.R.) at which each ball is launched, as well as the coefficient of lift ("$C_L$") and the coefficient of drag ("$C_D$") experienced by the ball during its flight. For ITR measurements in this experiment, in accordance with typical practice, six balls of every ball type (i.e., the smooth, control golf ball and the modified rough coated version of this same ball) were shot through the ITR system, and each ball was shot in a "seam orientation" (i.e., seam aligned with a vertical plane and oriented in the direction of launch) and a "pole orientation" (i.e., seam aligned with a horizontal plane). Moreover, the balls were launched through the ITR system at 15 different Reynolds number and spin ratio combinations (for a total of 180 ITR shots and measurements per ball type), ranging from Reynolds number of about 72,000 to Reynolds number of about 220,000. The fifteen Reynolds number and spin ratio settings corresponded to those used in conventional USGA testing.

The launch conditions, initial velocity, starting angle, and spin for driver shot simulation during some ITR testing were set to about 266 km/h (242 ft/sec), 11.3°, and 44.7 revolutions/sec (2682 RPM), respectively, to mimic launch conditions of a typical professional golfer (these are average driver launch conditions measured in 2009 on the PGA Tour). Various other launch conditions also were tested, e.g., at various different Reynolds number and spin ratio conditions, as noted above.

Figure 12:
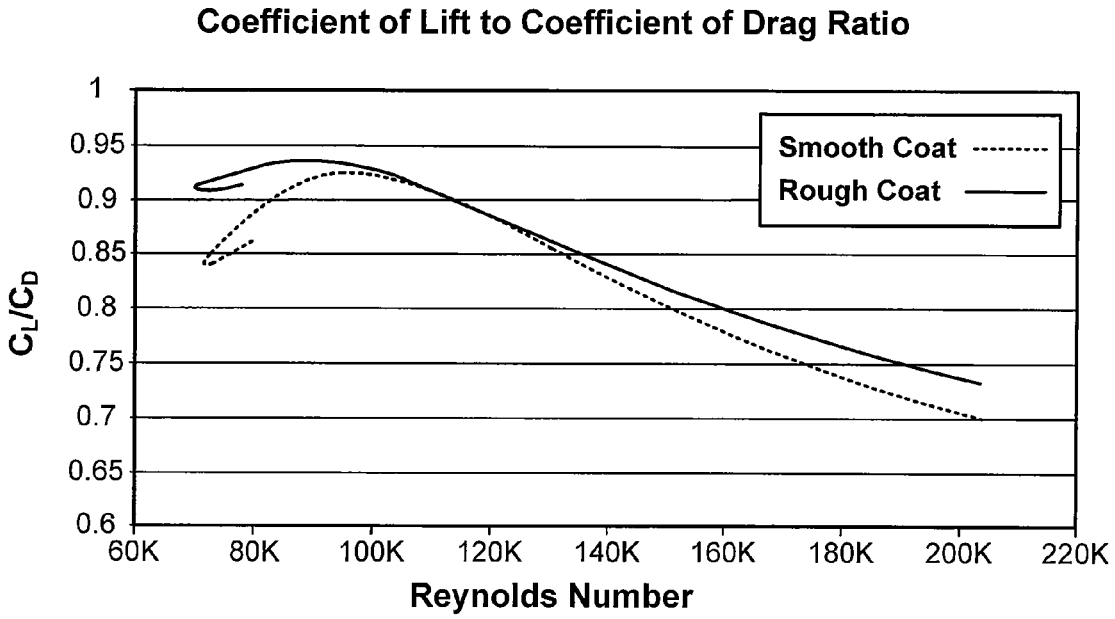
FIG. 12 is a graph illustrating the ratio of coefficient of lift against coefficient of drag for roughened balls in accordance with examples of this invention and smooth control balls at various Reynolds number and/or other launch conditions.

FIG. 12 is a graph showing the measured coefficient of lift to coefficient of drag ratio ($C_L/C_D$) over the tested range of Reynolds numbers using ITR testing for the smooth coated (control) balls and the rough coated (inventive) balls with the balls launched in the pole position. Notably, the roughened (inventive) balls displayed a higher $C_L/C_D$ ratio over all or substantially all of the Reynolds number range tested. The difference in $C_L/C_D$ ratio is most prominent at the extreme ends of the test ranges. For example, as shown in FIG. 12, at a Reynolds number of about 72,000, the smooth control ball had a $C_L/C_D$ ratio of about 0.84, while the roughened (inventive) ball had a $C_L/C_D$ ratio of about 0.91 (more than an 8% higher $C_L/C_D$ ratio). Also, at a Reynolds number of about 205,000, the smooth control ball had a $C_L/C_D$ ratio of about 0.70, while the roughened (inventive) ball had a $C_L/C_D$ ratio of about 0.73 (more than a 4% higher $C_L/C_D$ ratio).

Figure 13:
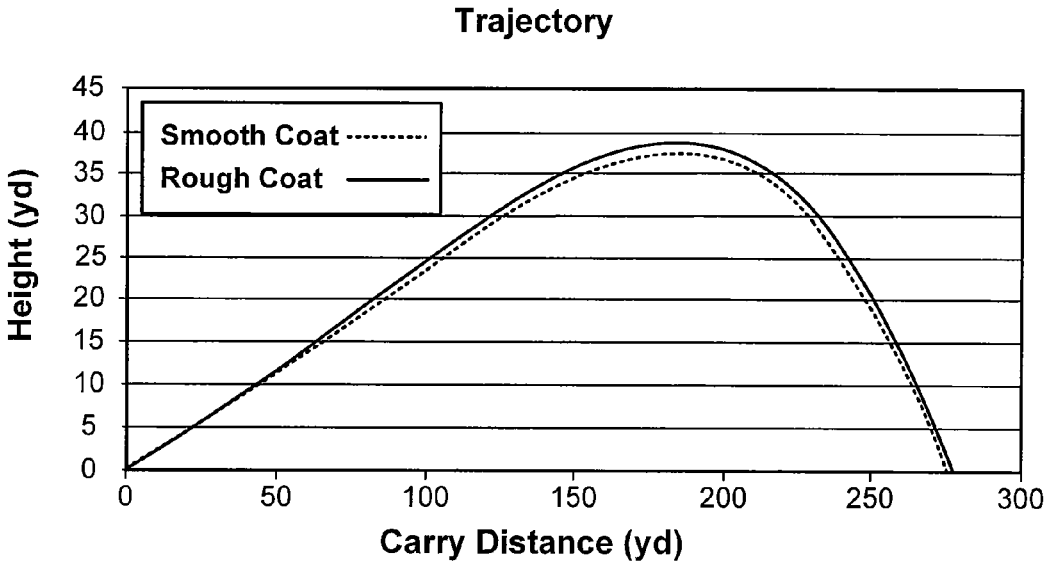
FIG. 13 is a graph illustrating vertical trajectory for roughened balls in accordance with examples of this invention and smooth control balls as launched under conditions representative of those of an "average" professional player.

The difference in trajectories (vertical) between these two ball types (with the balls launched in the pole orientation) is illustrated in the graph of FIG. 13, which shows a plot of ball height against ball flight carry yardage. Notably, the apex of the roughened (inventive) ball is about 1.4 yds (1.28 m) higher than that of the smooth (control) ball. The overall difference in carry length is 1.46 yds (1.33 m), with the roughened (inventive) ball having the longer carry. The following Table provides some additional data obtained during ITR testing of these two types of balls.

TABLE 2

DRIVER SHOT SIMULATION DATA FOR TESTED BALLS IN POLE ORIENTATION

| Parameter | Control Ball | Inventive Ball | % Difference |
|---|---|---|---|
| Speed (ft/s) (Predetermined Launch Condition) | 242 | 242 | 0 |
| Launch Angle (°) (Predetermined Launch Condition) | 11.3 | 11.3 | 0 |
| Spin (rev/s) (Predetermined Launch Condition) | 44.7 | 44.7 | 0 |
| Carry (yd) | 275.8 | 277.2 | +0.51% |
| Loft Time (s) | 7.18 | 7.39 | +2.9% |
| Total Distance (yd) | 291.2 | 292.4 | +0.41% |
| Descent Angle (°) | 41.4 | 41.8 | +1.0% |
| V (f) | 94.8 | 92.7 | −2.2% |
| Max Height (yd) ("Apex") | 37.5 | 38.9 | +3.7% |
| Carry Distance at Max Height (yd) | 185.7 | 184.0 | −0.92% |
| Max Angle Player Sees (°) | 12.38 | 12.93 | +4.4% |

Notably, the ball in accordance with the example of this invention has a longer carry, a longer flight time, and a higher apex.

Figure 14:
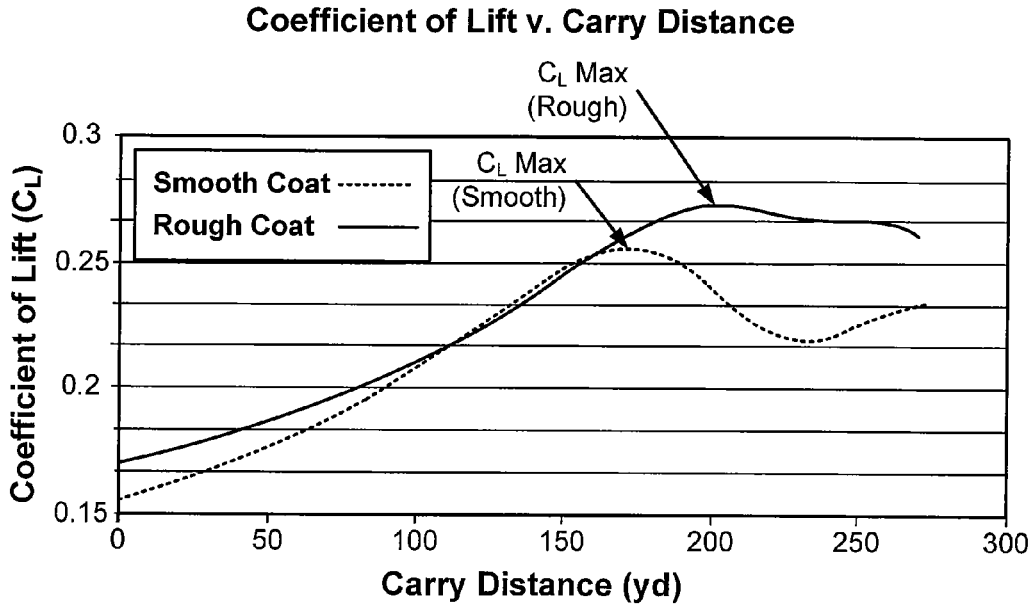
FIG. 14 is a graph illustrating coefficient of lift v. carry distance for roughened balls in accordance with examples of this invention and smooth control balls as launched under conditions representative of those of an "average" professional player.
Figure 15:
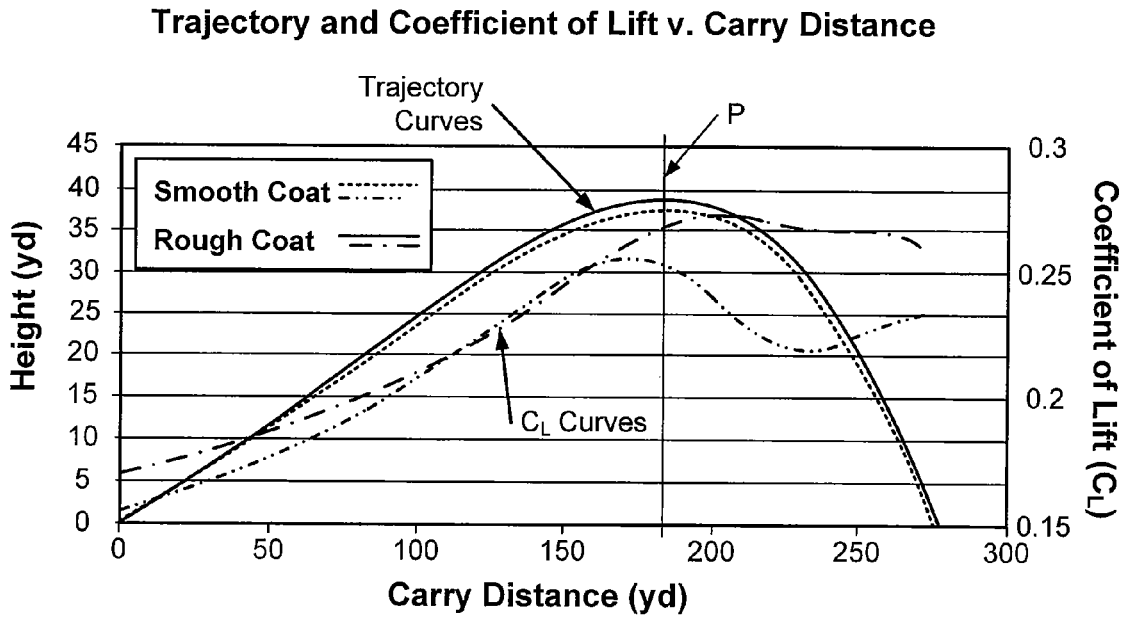
FIG. 15 combines the data of FIGS. 13 and 14 on a single graph to allow consideration of certain aspects and features of the measured data.

FIG. 14 shows a plot of the coefficient of lift ($C_L$) for the two ball types tested under the above noted driver launch conditions for FIG. 13 throughout the flight (in the pole orientation), and FIG. 15 shows both the trajectory curves (from FIG. 13) and the coefficient of lift data (from FIG. 14) in a single graph plotted against the carry distance. Notably, these figures show an increase in the coefficient of lift throughout almost the entire ball flight trajectory. More specifically, as shown in these figures, early in the flight (e.g., at launch and inside 80 yards of carry), the roughened (inventive ball) has a higher coefficient of lift than the control ball. As a golf ball is launched with backspin, the lift force helps get the ball into the air and fly farther because the lift force counteracts against gravitation forces pulling the ball back down to the ground (and thus, depending on spin conditions, a higher coefficient of lift at launch can be beneficial, at least for some players). From about 100 yards to 165 yards of carry, the coefficients of lift for the two ball types are substantially the same. As the balls reach their apexes (e.g., from about 170 yds of carry and beyond), however, dramatic differences in the coefficient of lift are shown. More specifically, as shown in FIGS. 14 and 15, the roughened (inventive) ball maintains a relatively high coefficient of lift beyond the flight apex (e.g., greater than or about 0.26) as compared to the coefficient of lift for the control ball (which dipped to about 0.22). Moreover, the roughened (inventive) ball's coefficient of lift remains higher than that of the control ball throughout the balls' descents. This is shown in FIG. 15 by the vertical separation of the $C_L$ curves beyond the upper peaks in the trajectory curves (i.e., to the right of line P located at the area of the trajectory peaks of the two balls). Maintaining as high a coefficient of lift as possible at the end of the ball flight (i.e., after the ball's apex) is desirable for at least some players because this tends to keep the ball up in the air a little longer during descent, thereby providing longer carry distances (e.g., balls having low coefficients of lift after the apex tend to have a flight that appears more like "dropping out of the sky").

Notably, FIGS. 14 and 15 also show that the coefficient of lift for the roughened (inventive) ball reaches its peak or maximum ($C_L$ Max) at a greater carry distance (about 200 yds) than the location of the coefficient of lift peak or maximum ($C_L$ Max) for the control ball (at about 173 yds). Thus, in this example, the roughened ball experienced an increased coefficient of lift and an increasing coefficient of lift through a longer portion of the ball's flight (as compared to the control ball).

The following Table provides some additional ITR test results and data (measured as described above) for both the pole and seam orientations for golf balls in accordance with examples of this invention and their smooth coated counterparts.

TABLE 3

ITR DATA FOR VARIOUS PARAMETERS OF GOLF BALLS

| | Control Ball-Pole | Inventive Ball-Pole | Pole % Difference (Rough v. Smooth) | Control Ball-Seam | Inventive Ball-Seam | Seam % Difference (Rough v. Smooth) |
|---|---|---|---|---|---|---|
| Max $C_D$ | 0.286 | 0.298 | +4.20% | 0.314 | 0.311 | −0.96% |
| Max $C_L$ | 0.256 | 0.273 | +6.64% | 0.280 | 0.290 | +3.57% |
| X Location of Max $C_L$ | 172.7 yd | 202.0 yd | +17.0% | 205.2 yd | 220.9 yd | +7.65% |
| Y Height of Max $C_L$ | 37.0 yd | 37.8 yd | +2.16% | 34.7 yd | 31.9 yd | −8.07% |
| Max $C_L/C_D$ | 0.924 | 0.935 | +1.19% | 0.907 | 0.938 | +3.42% |
| $C_L/C_D$ at Launch | 0.699 | 0.733 | +4.86% | 0.670 | 0.706 | +5.37% |
| $C_D$ at Launch | 0.223 | 0.232 | +4.04% | 0.222 | 0.231 | +4.05% |
| $C_L$ at Launch | 0.156 | 0.170 | +8.97% | 0.149 | 0.163 | +9.40% |
| Total Carry Distance | 275.8 yd | 277.2 yd | +0.51% | 277.3 yd | 277.7 yd | +0.14% |
| Max Height | 37.5 yd | 38.9 yd | +3.73% | 36.0 yd | 36.7 yd | +1.94% |
| Carry Distance at Max Height | 185.7 yd | 184.0 | −0.92% | 183.8 yd | 182.5 yd | −0.71% |

The golf ball body of the present invention has no limitation on its structure and includes a one-piece golf ball, a two-piece golf ball, a multi-piece golf ball comprising at least three layers, and a wound-core golf ball, including balls with different constructions, materials, and the like. Moreover, the present invention can be applied to any type of dimple pattern, including patterns with at least some non-round dimples (e.g., polygonal dimples, asymmetric dimples, dual radius dimples, etc.). The present invention can be applied for all types of the golf ball.

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with the figures may be used individually and/or in any combination or subcombination without departing from this invention.

We claim:

1. A golf ball, comprising:

a golf ball body having a first set of construction specifications and a first dimple pattern formed on an outer surface of the golf ball body; and a coating applied to the outer surface of the golf ball body to thereby produce a coated golf ball body having an exterior surface, wherein the coating includes a resin and a plurality of surface roughening particles, wherein the surface roughening particles have an average size of 400 nm to 40 μm, wherein the surface roughening particles are present in a sufficient amount at the exterior surface of the coated golf ball body such that an average micro surface roughness of the exterior surface of the golf ball is between about 1.3 μm and about 3 μm, and wherein micro surface roughness includes deviations from an ideal surface of 0.25 mm or less.

2. The golf ball according to claim 1, wherein the particles have an average size of 5 to 20 microns.

3. The golf ball according to claim 1, wherein the resin has an average thickness of 8 to 50 microns.

4. The golf ball according to claim 1, wherein the resin has an average thickness of 10 to 15 microns.

5. The golf ball of claim 1, wherein the resin includes a thermoplastic elastomer.

6. The golf ball of claim 1, wherein the particles comprise 1 to 30 wt % of the total weight of the coating.

7. The golf ball of claim 1, wherein the particles are selected from the group consisting of: fumed silica, amorphous silica, colloidal silica, alumina, colloidal alumina, titanium oxide, cesium oxide, yttrium oxide, colloidal yttria, zirconia, colloidal zirconia, polyethylene terephthalate, polybutylene terephthalate, polyethylene naphthalate, vinyl esters, epoxy materials, phenolics, aminoplasts, polyurethanes and composite particles of silicon carbide or aluminum nitride coated with silica or carbonate.

8. The golf ball according to claim 1, wherein the coating includes particles contained within the resin.

9. The golf ball according to claim 1, wherein the coating includes a resin layer applied to the outer surface of the golf ball body and a plurality of particles adhered to or embedded in an outer surface of the resin layer.

10. The golf ball according to claim 1, wherein the golf ball body includes a core and a cover layer, wherein the plurality of dimples are formed in the cover layer.

11. The golf ball according to claim 1, wherein the micro surface roughness constitutes an average micro surface roughness of at least 7.5% of an entire surface area of the ball, wherein the 7.5% of the entire surface areas is dispersed over at least 36 discrete locations on the surface of the ball.

12. The golf ball according to claim 1, wherein the micro surface roughness constitutes an average micro surface roughness of at least 7.5% of an entire surface area of the ball, wherein the 7.5% of the entire surface areas includes surface area surrounding at least 36 different dimples dispersed around the surface of the ball.

13. A golf ball, comprising:

a golf ball body having a first set of construction specifications and a first dimple pattern formed on an outer surface of the golf ball body; and a coating applied to the outer surface of the golf ball body to thereby produce a coated golf ball body having an exterior surface, wherein the coating includes a resin and a plurality of surface roughening particles, wherein the surface roughening particles have an average size of 400 nm to 40 μm, wherein the surface roughening particles are present in a sufficient amount at the exterior surface of the coated golf ball body such that an average micro surface roughness of the exterior surface of the golf ball is between about 1.3 μm and about 3 μm and the golf ball exhibits a coefficient of lift at initial launch that is at least 5% higher as compared to a coefficient of lift at initial launch of a comparative ball having the first set of construction specifications and the first dimple pattern but not including the surface roughening particles, wherein micro surface roughness includes deviations from an ideal surface of 0.25 mm or less and wherein the coefficient of lift is measured at initial launch using standard USGA indoor test range testing protocols with balls launched in a pole orientation at an initial launch velocity of 242 ft/s, an initial launch angle of 11.3°, and an initial launch spin of 44.7 revolutions/s.

14. A golf ball, comprising:

a golf ball body having a first set of construction specifications and a first dimple pattern formed on an outer surface of the golf ball body; and a coating applied to the outer surface of the golf ball body to thereby produce a coated golf ball body having an exterior surface, wherein the coating includes a resin and a plurality of surface roughening particles, wherein the surface roughening particles have an average size of 400 nm to 40 μm, wherein the surface roughening particles are present in a sufficient amount at the exterior surface of the coated golf ball body such that an average micro surface roughness of the exterior surface of the golf ball is between about 1.3 μm and about 3 μm and the golf ball exhibits a maximum coefficient of lift at a location at least 15 yards farther from an initial launch point as compared to a location of a maximum coefficient of lift of a comparative ball having the first set of construction specifications and the first dimple pattern but not including the surface roughening particles, wherein micro surface roughness includes deviations from an ideal surface of 0.25 mm or less and wherein the coefficient of lift is measured using standard USGA ITR testing protocols with balls launched in a pole orientation at an initial launch velocity of 242 ft/s, an initial launch angle of 11.3°, and an initial launch spin of 44.7 revolutions/s.

15. A golf ball, comprising:

a golf ball body having a first set of construction specifications and a first dimple pattern formed on an outer surface of the golf ball body; and a coating applied to the outer surface of the golf ball body to thereby produce a coated golf ball body having an exterior surface, wherein the coating includes a resin and a plurality of surface roughening particles, wherein the surface roughening particles have an average size of 400 nm to 40 μm, wherein the surface roughening particles are present in a sufficient amount at the exterior surface of the coated golf ball body such that an average micro surface roughness of the exterior surface of the golf ball is between about 1.3 μm and about 3 μm and the golf ball exhibits a maximum coefficient of lift that is at least 5% higher than a maximum coefficient of lift of a comparative ball having the first set of construction specifications and the first dimple pattern but not including the surface roughening particles, wherein micro surface roughness includes deviations from an ideal surface of 0.25 mm or less and wherein the coefficient of lift is measured using standard USGA indoor test range testing protocols with balls launched in a pole orientation at an initial launch velocity of 242 ft/s, an initial launch angle of 11.3°, and an initial launch spin of 44.7 revolutions/s.

16. A golf ball, comprising:

a golf ball body having a first set of construction specifications and a first dimple pattern formed on an outer surface of the golf ball body; and a coating applied to the outer surface of the golf ball body to thereby produce a coated golf ball body having an exterior surface, wherein the coating includes a resin and a plurality of surface roughening particles, wherein the surface roughening particles have an average size of 400 nm to 40 μm, wherein the surface roughening particles are present in a sufficient amount at the exterior surface of the coated golf ball body such that an average micro surface roughness of the exterior surface of the golf ball is between about 1.3 μm and about 3 μm and the golf ball exhibits a higher coefficient of lift throughout its descent as compared to a coefficient of lift during descent of a comparative ball having the first set of construction specifications and the first dimple pattern but not including the surface roughening particles, wherein micro surface roughness includes deviations from an ideal surface of 0.25 mm or less and wherein the coefficient of lift is measured using standard USGA indoor test range testing protocols with balls launched in a pole orientation at an initial launch velocity of 242 ft/s, an initial launch angle of 11.3°, and an initial launch spin of 44.7 revolutions/s.

17. A golf ball, comprising:

a golf ball body having a first set of construction specifications and a first dimple pattern formed on an outer surface of the golf ball body; and a coating applied to the outer surface of the golf ball body to thereby produce a coated golf ball body having an exterior surface, wherein the coating includes a resin and a plurality of surface roughening particles, wherein the surface roughening particles have an average size of 400 nm to 40 μm, wherein the surface roughening particles are present in a sufficient amount at the exterior surface of the coated golf ball body such that an average micro surface roughness of the exterior surface of the golf ball is between about 1.3 μm and about 3 μm and the golf ball exhibits a ratio of coefficient of lift to coefficient of drag at initial launch that is at least 4% higher as compared to a ratio of coefficient of lift to coefficient of drag at initial launch of a comparative ball having the first set of construction specifications and the first dimple pattern but not including the surface roughening particles, wherein micro surface roughness includes deviations from an ideal surface of 0.25 mm or less and wherein the coefficient of lift and coefficient of drag are measured at initial launch using standard USGA indoor test range testing protocols with balls launched in a pole orientation at an initial launch velocity of 242 ft/s, an initial launch angle of 11.3°, and an initial launch spin of 44.7 revolutions/s.

18. A golf ball, comprising:

a golf ball body having a first set of construction specifications and a first dimple pattern formed on an outer surface of the golf ball body; and a coating applied to the outer surface of the golf ball body to thereby produce a coated golf ball body having an exterior surface, wherein at least one of the outer surface of the golf ball body and the coating includes a plurality of surface roughening particles, wherein the surface roughening particles are present in a sufficient amount at the exterior surface of the coated golf ball body such that an average micro surface roughness of the golf ball is between about 1.3 μm and about 3 μm, and wherein micro surface roughness includes deviations from an ideal surface of 0.25 mm or less.

19. The golf ball according to claim 18, wherein the micro surface roughness constitutes an average micro surface roughness of at least 7.5% of an entire surface area of the ball, wherein the 7.5% of the entire surface areas is dispersed over at least 36 discrete locations on the surface of the ball.

20. The golf ball according to claim 18, wherein the micro surface roughness constitutes an average micro surface roughness of at least 7.5% of an entire surface area of the ball, wherein the 7.5% of the entire surface areas includes surface area surrounding at least 36 different dimples dispersed around the surface of the ball.

21. A golf ball, comprising:

a golf ball body having a first set of construction specifications and a first dimple pattern formed on an outer surface of the golf ball body; and a coating applied to the outer surface of the golf ball body to thereby produce a coated golf ball body having an exterior surface, wherein at least one of the outer surface of the golf ball body and the coating includes a plurality of surface roughening particles, wherein the surface roughening particles are present in a sufficient amount at the exterior surface of the coated golf ball body such that an average micro surface roughness of the exterior surface of the golf ball is between about 1.3 μm and about 3 μm and the golf ball exhibits a coefficient of lift at initial launch that is at least 5% higher as compared to a coefficient of lift at initial launch of a comparative ball having the first set of construction specifications and the first dimple pattern but not including the surface roughening particles, wherein micro surface roughness includes deviations from an ideal surface of 0.25 mm or less and wherein the coefficient of lift is measured at initial launch using standard USGA indoor test range testing protocols with balls launched in a pole orientation at an initial launch velocity of 242 ft/s, an initial launch angle of 11.3°, and an initial launch spin of 44.7 revolutions/s.

22. A golf ball, comprising:

a golf ball body having a first set of construction specifications and a first dimple pattern formed on an outer surface of the golf ball body; and a coating applied to the outer surface of the golf ball body to thereby produce a coated golf ball body having an exterior surface, wherein at least one of the outer surface of the golf ball body and the coating includes a plurality of surface roughening particles, wherein the surface roughening particles are present in a sufficient amount at the exterior surface of the coated golf ball body such that an average micro surface roughness of the exterior surface of the golf ball is between about 1.3 μm and about 3 μm and the golf ball exhibits a maximum coefficient of lift at a location at least 15 yards farther from an initial launch point as compared to a location of a maximum coefficient of lift of a comparative ball having the first set of construction specifications and the first dimple pattern but not including the surface roughening particles, wherein micro surface roughness includes deviations from an ideal surface of 0.25 mm or less and wherein the coefficient of lift is measured using standard USGA ITR testing protocols with balls launched in a pole orientation at an initial launch velocity of 242 ft/s, an initial launch angle of 11.3°, and an initial launch spin of 44.7 revolutions/s.

23. A golf ball, comprising:

a golf ball body having a first set of construction specifications and a first dimple pattern formed on an outer surface of the golf ball body; and a coating applied to the outer surface of the golf ball body to thereby produce a coated golf ball body having an exterior surface, wherein at least one of the outer surface of the golf ball body and the coating includes a plurality of surface roughening particles, wherein the surface roughening particles are present in a sufficient amount at the exterior surface of the coated golf ball body such that an average micro surface roughness of the exterior surface of the golf ball is between about 1.3 μm and about 3 μm and the golf ball exhibits a maximum coefficient of lift that is at least 5% higher than a maximum coefficient of lift of a comparative ball having the first set of construction specifications and the first dimple pattern but not including the surface roughening particles, wherein micro surface roughness includes deviations from an ideal surface of 0.25 mm or less and wherein the coefficient of lift is measured using standard USGA indoor test range testing protocols with balls launched in a pole orientation at an initial launch velocity of 242 ft/s, an initial launch angle of 11.3°, and an initial launch spin of 44.7 revolutions/s.

24. A golf ball, comprising:

a golf ball body having a first set of construction specifications and a first dimple pattern formed on an outer surface of the golf ball body; and a coating applied to the outer surface of the golf ball body to thereby produce a coated golf ball body having an exterior surface, wherein at least one of the outer surface of the golf ball body and the coating includes a plurality of surface roughening particles, wherein the surface roughening particles are present in a sufficient amount at the exterior surface of the coated golf ball body such that an average micro surface roughness of the exterior surface of the golf ball is between about 1.3 μm and about 3 μm and the golf ball exhibits a higher coefficient of lift throughout its descent as compared to a coefficient of lift during descent of a comparative ball having the first set of construction specifications and the first dimple pattern but not including the surface roughening particles, wherein micro surface roughness includes deviations from an ideal surface of 0.25 mm or less and wherein the coefficient of lift is measured using standard USGA indoor test range testing protocols with balls launched in a pole orientation at an initial launch velocity of 242 ft/s, an initial launch angle of 11.3°, and an initial launch spin of 44.7 revolutions/s.

25. A golf ball, comprising:

a golf ball body having a first set of construction specifications and a first dimple pattern formed on an outer surface of the golf ball body; and a coating applied to the outer surface of the golf ball body to thereby produce a coated golf ball body having an exterior surface, wherein at least one of the outer surface of the golf ball body and the coating includes a plurality of surface roughening particles, wherein the surface roughening particles are present in a sufficient amount at the exterior surface of the coated golf ball body such that an average micro surface roughness of the exterior surface of the golf ball is between about 1.3 μm and about 3 μm and the golf ball exhibits a ratio of coefficient of lift to coefficient of drag at initial launch that is at least 4% higher as compared to a ratio of coefficient of lift to coefficient of drag at initial launch of a comparative ball having the first set of construction specifications and the first dimple pattern but not including the surface roughening particles, wherein micro surface roughness includes deviations from an ideal surface of 0.25 mm or less and wherein the coefficient of lift and coefficient of drag are measured at initial launch using standard USGA indoor test range testing protocols with balls launched in a pole orientation at an initial launch velocity of 242 ft/s, an initial launch angle of 11.3°, and an initial launch spin of 44.7 revolutions/s.

* * * * *